US009192024B2

(12) United States Patent
Ohta

(10) Patent No.: US 9,192,024 B2
(45) Date of Patent: Nov. 17, 2015

(54) DIMMING CONSOLE

(71) Applicant: Panasonic Intellectual Property Management Co., Ltd., Osaka (JP)

(72) Inventor: Kenji Ohta, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 14/526,922

(22) Filed: Oct. 29, 2014

(65) Prior Publication Data

US 2015/0115836 A1 Apr. 30, 2015

(30) Foreign Application Priority Data

Oct. 30, 2013 (JP) ..... 2013-226049

(51) Int. Cl.

| | |
|---|---|
| ***H05B 37/00*** | (2006.01) |
| ***H05B 39/00*** | (2006.01) |
| ***H05B 41/00*** | (2006.01) |
| ***H05B 37/02*** | (2006.01) |

(52) U.S. Cl.

CPC ..... *H05B 37/02* (2013.01)

(58) Field of Classification Search

None

See application file for complete search history.

(56) References Cited

U.S. PATENT DOCUMENTS

| | | | | |
|---|---|---|---|---|
| 2006/0103333 | A1* | 5/2006 | Toms | 315/312 |
| 2008/0140231 | A1* | 6/2008 | Blackwell et al. | 700/90 |
| 2013/0249433 | A1* | 9/2013 | Martello et al. | 315/292 |

FOREIGN PATENT DOCUMENTS

| | | |
|---|---|---|
| JP | 2004-127722 | 4/2004 |

* cited by examiner

*Primary Examiner* — Anh Tran

(74) *Attorney, Agent, or Firm* — Renner, Otto, Boisselle & Sklar, LLP

(57) ABSTRACT

A dimming console serves to store output levels of a plurality of lighting instruments and control the output levels of the plurality of lighting instruments. The dimming console includes an output unit configured to output, to a display, a scene preparation region that displays scenes indicating at least states of the output levels of the plurality of lighting instruments and a scene storage region indicating playback order information regarding a scene playback order; an input unit configured to receive an operation for the scene preparation region and an operation for the scene storage region; and a control unit configured to edit the scenes or the playback order information pursuant to the operation of the input unit and to control the output unit to output the edited scenes or the edited playback order information.

4 Claims, 12 Drawing Sheets

DIMMING CONSOLE

CROSS-REFERENCES TO RELATED APPLICATIONS

This application claims priority to Japanese Patent Application No. 2013-226049 filed with the Japan Patent Office on Oct. 30, 2013, the entire contents of which are incorporated herein by reference.

TECHNICAL FIELD

The present disclosure relates to a dimming console for preparing a scene.

BACKGROUND ART

Japanese Unexamined Patent Application Publication No. 2004-127722 (JP2004-127722A) discloses one example of a dimming console having a display. Paragraph [0029] of JP2004-127722A reads as follows. "Thus, the setting of an output level corresponding to a designated channel or the editing of a scene can be performed using an operation console 20 that constitutes an operation input unit 2 shown in FIG. 3. A SW 10 is an operation button which is operated during transition to a scene playback screen (not shown). A SW 11 is an operation button which is operated during transition to a screen (not shown) for setting a control method such as dimming control or the like. The operations on these screens are not an important part of the present invention and therefore will not be described."

The dimming console of JP2004-127722A includes a display for checking and editing a list of scenes based on the scene number and a channel level of the respective scene. For that reason, it is difficult to efficiently check and edit the storage and arrangement of scenes which are effective in playing back the scenes.

SUMMARY OF THE INVENTION

In view of the above, the present disclosure provides a dimming console which contributes to efficiently preparing a scene.

In accordance with an aspect of the present invention, there is provided a dimming console which is to be connected to a plurality of lighting instruments, the dimming console serving to store output levels of the plurality of lighting instruments and control the plurality of lighting instruments. The dimming console includes: an output unit configured to output, to a display, a scene preparation region that displays scenes indicating at least states of the output levels of the plurality of lighting instruments and a scene storage region indicating playback order information regarding a scene playback order; an input unit configured to receive an operation for the scene preparation region and an operation for the scene storage region; and a control unit configured to edit the scenes or the playback order information pursuant to the operation of the input unit and to control the output unit to output the edited scenes or the edited playback order information.

The scene storage region, a plurality of scene icons, which indicates the scenes, may be arranged based on the scene playback order.

The input unit may include a touch panel.

In accordance with another aspect of the present invention, there is provided a method for operating a plurality of lighting instruments by using a dimming console which is connected to the plurality of lighting instruments, and serves to store output levels of the plurality of lighting instruments and control the plurality of lighting instruments. The operating method includes: instructing an output unit of the dimming console to output, to a display, a scene preparation region that displays scenes indicating at least states of the output levels of the plurality of lighting instruments and a scene storage region indicating playback order information regarding a scene playback order; receiving an operation for the scene preparation region and an operation for the scene storage region through an input unit of the dimming console; editing the scenes or the playback order information pursuant to instruction received through the input unit and controlling the output unit to output the edited scenes or the edited playback order information to the display; and instructing the plurality of lighting instruments to play back the scenes sequentially pursuant to the instruction received through the input unit.

The present dimming console can contribute to efficiently preparing a scene.

BRIEF DESCRIPTION OF THE DRAWINGS

The figures depict one or more implementation in accordance with the present teaching, by way of example only, not by way of limitations. In the figures, like reference numerals refer to the same or similar elements.

Figure 1:
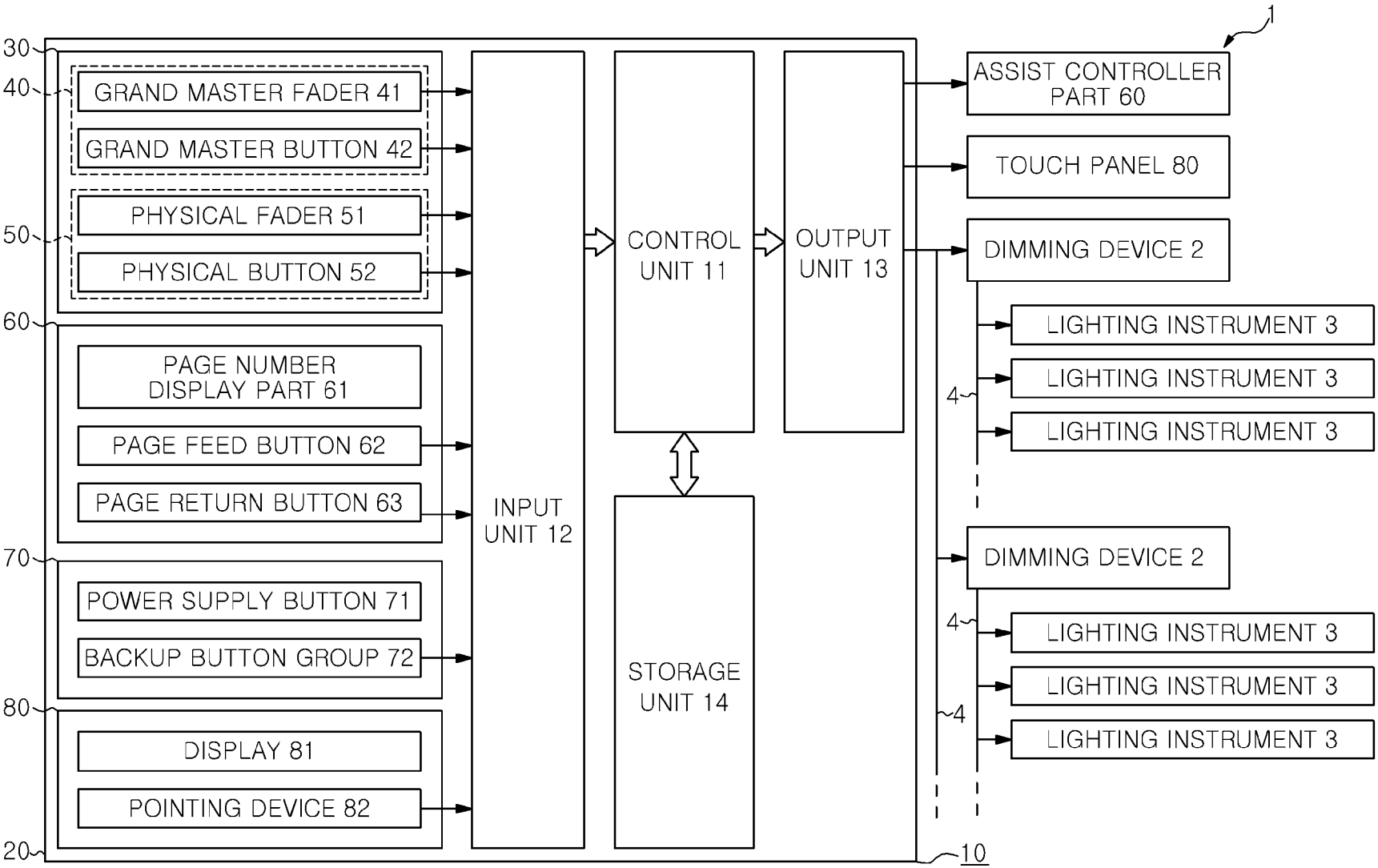
FIG. 1 is a block diagram of a dimming system according to an embodiment.

DETAILED DESCRIPTION OF THE EMBODIMENTS (First Embodiment)

The configuration of a dimming system 1 will now be described with reference to FIG. 1. The dimming system 1 is used in a lighting technology for producing a stage or the like through lighting. Such production is usually referred to as production lighting or stage lighting. The dimming system 1 includes a dimming console 10, a plurality of dimming devices 2, a plurality of lighting instruments 3, and a plurality of communication cables 4. One example of the dimming console 10 is a DMX controller. One example of a communication protocol of the dimming console 10 with the dimming devices 2 and the lighting instruments 3 is DMX512. The dimming system 1 has a function of producing a stage or the like by controlling the output level of the lighting instruments 3 with the dimming console 10.

Figure 2:
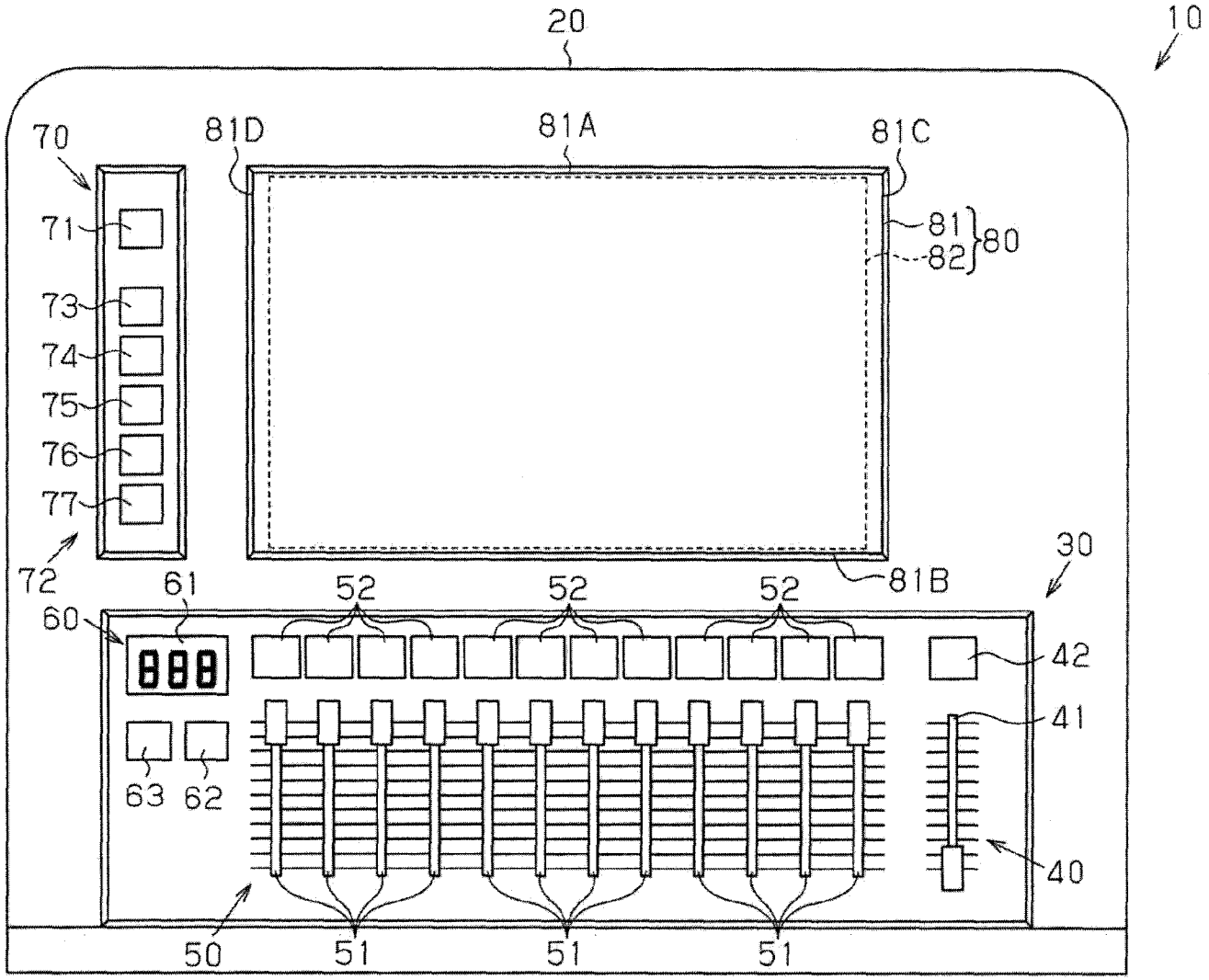
FIG. 2 is a front view of a dimming console according to the embodiment.

The configuration of the dimming console 10 will be described with reference to FIG. 2. One example of the dimming console 10 is a tablet-type terminal. The dimming console 10 includes a console housing 20, a fader panel unit 30, a button panel unit 70, and a touch panel 80. A control unit 11, an input unit 12, an output unit 13 and a storage unit 14 are disposed within a console housing 20.

The dimming console 10 defines an upper side, a lower side, a right side, a left side, a height direction and a width direction. These sides and directions indicate the sides and directions viewed from an operator who directly faces a display 81 of the dimming console 10. The height direction generically indicates both the upper side and the lower side of the dimming console 10. The width direction generically indicate both the right side and the left side of the dimming console 10.

The touch panel 80 includes a display 81 and a pointing device 82. The touch panel 80 displays the information regarding the preparation and playback of a scene on the display 81. The touch panel 80 detects an operator's operation of the display 81 (hereinafter referred to as an "input operation") using the pointing device 82. The touch panel 80 outputs a signal, which is changed in response to the input operation, from the pointing device 82 to the input unit 12.

One example of the display 81 is a liquid crystal display. One example of the shape of the display 81 is a rectangular shape. The display 81 includes an upper side 81A, a lower side 81A, a right side 81C and a left side 81D. The display 81 is disposed above the fader panel unit 30 in the height direction.

The fader panel unit 30 is a man-machine interface operated by an operator for the editing and playback of a scene. The fader panel unit 30 includes one grand master part 40, twelve physical controller parts 50 and one assist controller part 60. In the following description, one physical controller part 50 will be just referred to as a "physical controller part 50".

The grand master part 40 has a role in collectively managing all the lighting instruments 3 and all the scenes. The grand master part 40 includes one grand master fader 41 and one grand master button 42. The grand master fader 41 changes the output level of all the lighting instruments 3 depending on the fader operation position. The grand master button 42 is disposed above the grand master fader 41. The grand master button 42 starts or stops the playback of all the scenes. The grand master button 42 plays back the scenes pursuant to the scene playback order information.

The physical controller part 50 has a role in playing back a scene pursuant to an operator's operation (manual operation). The physical controller part 50 includes one physical fader 51 and one physical button 52. The physical controller part 50 is disposed at a position corresponding to the adjoining side, i.e., the lower side 81B, of the display 81 in the height direction.

The physical fader 51 has a function of manually playing back a corresponding scene. The physical fader 51 has a function of changing the output level of the lighting instruments 3 which form a scene, depending on the fader operation position. The physical fader 51 has a function of playing back a scene allotted to a corresponding executor 150 (see FIG. 3).

The physical button 52 is disposed above the physical fader 51. The physical button 52 has a function of time-dependently playing back a corresponding scene. The physical button 52 has a function of switching the execution and stop of the time-dependent playback each time when a push operation is performed. The physical button 52 has a function of time-dependently playing back a scene allotted to a corresponding executor 150 (see FIG. 3). The time-dependent playback refers to a scene playback method in which a scene is played back pursuant to the cue information set in one scene.

The assist controller part 60 has a function of switching a scene-corresponding page displayed on the display 81. The assist controller part 60 is disposed at the left side of the physical controller part 50. The assist controller part 60 includes a page number display part 61, a page feed button 62 and a page return button 63.

The page number display part 61 has a function of displaying the number associated with the scene-corresponding page displayed on the display 81. The page feed button 62 has a function of, when pushed, switching the scene-corresponding page to the next page. The page return button 63 has a function of, when pushed, switching the scene-corresponding page to the previous page. The scene-corresponding page indicates the correspondence relationship between the respective physical faders 51 and the stored scenes.

The button panel unit 70 includes a plurality of buttons having different kinds of functions. The button panel unit 70 is disposed at the left side of the display 81. The button panel unit 70 includes a power supply button 71 and a backup button group 72. The power supply button 71, when pushed, turns on or off a power supply of the dimming console 10.

The backup button group 72 has a function of backing up a scene and a function of playing back the scene thus backed up. The backup button group 72 includes a common backup button 73, a first backup button 74, a second backup button 75, a third backup button 76 and a fourth backup button 77. When the common backup button 73 and one of the respective backup buttons 74 to 77 are pushed in combination, a backup scene is stored in the storage unit 14 (see FIG. 1). When each of the respective backup buttons 74 to 77 is pushed independently, the scene associated with each of the respective backup buttons 74 to 77 is played back.

The operations of the respective functional parts of the dimming console 10 will be described with reference to FIG. 1. The respective functional parts of the dimming console 10 inputs different kinds of signals to the input unit 12 in the following manner. The grand master fader 41 inputs an output signal corresponding to the fader operation position to the input unit 12. The grand master button 42 inputs an output signal to the input unit 12 each time when the grand master button 42 is pushed. The physical fader 51 inputs an output signal corresponding to the fader operation position to the input unit 12. The physical button 52 inputs an output signal to the input unit 12 each time when the physical button 52 is pushed. The page feed button 62 inputs an output signal to the input unit 12 each time when the page feed button 62 is pushed. The page return button 63 inputs an output signal to the input unit 12 each time when the page return button 63 is pushed. The common backup button 73 (see FIG. 2), when pushed, inputs an output signal to the input unit 12. Each of the backup buttons 74 to 77 (see FIG. 2) inputs an output signal to the input unit 12 each time when each of the backup buttons 74 to 77 is pushed. The pointing device 82 inputs an output signal corresponding to the position of an input operation of the display 81 to the input unit 12.

The input unit 12 generates a fader operation position signal SG1 based on the output signal of the grand master fader 41 and inputs the fader operation position signal SG1 to the control unit 11. The input unit 12 generates a button operation signal SG2 based on the output signal of the grand master button 42 and inputs the button operation signal SG2 to the control unit 11.

The input unit 12 generates a fader operation position signal SS1 based on the output signal of the physical fader 51 and inputs the fader operation position signal SS1 to the control unit 11. The input unit 12 generates a button operation signal SS2 based on the output signal of the physical button 52 and inputs the button operation signal SS2 to the control unit 11.

The input unit 12 generates a button operation signal SP 1 based on the output signal of the page feed button 62 and inputs the button operation signal SP1 to the control unit 11. The input unit 12 generates a button operation signal SP2 based on the output signal of the page return button 63 and input the button operation signal SP2 to the control unit 11.

The input unit 12 generates a button operation signal SMC based on the output signal of the common backup button 73 and inputs the button operation signal SMC to the control unit 11. The input unit 12 generates a button operation signal SM1 based on the output signal of the first backup button 74 and inputs the button operation signal SM1 to the control unit 11. The input unit 12 generates a button operation signal SM2 based on the output signal of the second backup button 75 and inputs the button operation signal SM2 to the control unit 11. The input unit 12 generates a button operation signal SM3 based on the output signal of the third backup button 76 and input the button operation signal SM3 to the control unit 11. The input unit 12 generates a button operation signal SM4 based on the output signal of the fourth backup button 77 and inputs the button operation signal SM4 to the control unit 11.

The input unit 12 generates an input detection signal ST based on the output signal of the pointing device 82 and inputs the input detection signal ST to the control unit 11. The input detection signal ST is a signal which reflects an operator's request on the preparation and playback of a scene and is inputted to the control unit 11.

The operation of the control unit 11 will be described with reference to FIG. 1. The control unit 11 detects the fader operation position of the grand master fader 41 based on the fader operation position signal SG1. The control unit 11 generates a dimming control signal SA based on the fader operation position signal SG1. The control unit 11 inputs the dimming control signal SA, which is based on the fader operation position signal SG1, to the output unit 13, thereby changing the final output level of all the lighting instruments 3 depending on the fader operation position of the grand master fader 41.

The control unit 11 detects the push operation of the grand master button 42 based on the button operation signal SG2. The control unit 11 generates a dimming control signal SA based on the button operation signal SG2. The control unit 11 inputs the dimming control signal SA, which is based on the button operation signal SG2, to the output unit 13, thereby controlling the execution and stop of the playback of all the scenes in response to the push operation of the grand master button 42. Upon detecting the push operation of the grand master button 42 in a state in which the playback of all the scenes is not executed, the control unit 11 starts the playback of scenes one after another from the scene having the first playback order. Upon detecting the push operation of the grand master button 42 in a state in which the playback of all the scenes is executed, the control unit 11 stops the playback of scenes.

The control unit 11 detects the fader operation position of the physical fader 51 based on the fader operation position signal SS1. The control unit 11 generates a dimming control signal SA based on the fader operation position signal SS1. The control unit 11 inputs the dimming control signal SA, which is based on the fader operation position signal SS1, to the output unit 13, thereby controlling the output level of the lighting instruments 3 which form one scene, depending on the fader operation position of the physical fader 51.

The control unit 11 detects the push operation of the physical button 52 based on the button operation signal SS2. The control unit 11 generates a dimming control signal SA based on the button operation signal SS2. The control unit 11 input the dimming control signal SA, which is based on the button operation signal SS2, to the output unit 13, thereby controlling the execution and stop of the time-dependent playback of one scene in response to the push operation of the physical button 52. Upon detecting the push operation of the physical button 52 in a state in which the time-dependent playback of one scene is not executed, the control unit 11 starts the time-dependent playback of the scene. Upon detecting the push operation of the physical button 52 in a state in which the time-dependent playback of one scene is executed, the control unit 11 stops the time-dependent playback of the scene.

The control unit 11 detects the push operation of the page feed button 62 based on the button operation signal SP1. The control unit 11 generates a display control signal SB and a display control signal SC based on the button operation signal SP1. The control unit 11 inputs the display control signal SB, which is based on the button operation signal SP1, to the output unit 13, thereby changing the scene-corresponding page displayed on the display 81 in response to the push operation of the page feed button 62. The control unit 11 inputs the display control signal SC, which is based on the button operation signal SP1, to the output unit 13, thereby changing the page number displayed on the page number display part 61 in response to the push operation of the page feed button 62.

The control unit 11 detects the push operation of the page return button 63 based on the button operation signal SP2. The control unit 11 generates a display control signal SB and a display control signal SC based on the button operation signal SP2. The control unit 11 inputs the display control signal SB, which is based on the button operation signal SP2, to the output unit 13, thereby changing the scene-corresponding page displayed on the display 81 in response to the push operation of the page return button 63. The control unit 11 inputs the display control signal SC, which is based on the button operation signal SP2, to the output unit 13, thereby changing the page number displayed on the page number display part 61 in response to the push operation of the page return button 63.

Upon detecting the push operation of the page feed button 62 or the page return button 63 in a state in which the scene-corresponding page is not displayed on the display 81, the control unit 11 displays the scene-corresponding page on the display 81. Upon detecting the push operation of the page feed button 62 in a state in which the scene-corresponding page is displayed, the control unit 11 changes the scene-corresponding page to the next page. Upon detecting the push operation of the page return button 63 in a state in which the scene-corresponding page is displayed, the control unit 11 changes the scene-corresponding page to the previous page.

The control unit 11 detects the push operation of the combination of the common backup button 73 and one of the respective backup buttons 74 to 77 based on the button operation signal SMC and one of the button operation signals SM1 to SM4. The control unit 11 generates backup-purpose scene information based on the button operation signal SMC and one of the button operation signals SM1 to SM4. The control unit 11 has the backup-purpose scene information associated with the one of the respective backup buttons 74 to 77. The control unit 11 outputs the backup-purpose scene information to a backup region of the storage unit 14, thereby backing up the scene information in response to the push operation of the backup button group 72.

The control unit 11 detects the independent push operation of one of the respective backup buttons 74 to 77 based on one of the button operation signals SM1 to SM4. The control unit 11 acquires the corresponding backup-purpose scene information from the storage unit 14 based on one of the button operation signals SM1 to SM4. The control unit 11 generates a dimming control signal SA based on the scene information thus acquired. The control unit 11 inputs the dimming control signal SA, which is based on the scene information, to the output unit 13, thereby playing back the scene in response to the independent push operation of one of the respective backup button 74 to 77.

The control unit 11 detects the content of an input operation of the display 81 based on the input detection signal ST. The control unit 11 generates a display control signal SB based on the input detection signal ST. The control unit 11 outputs the display control signal SB, which is based on the input detection signal ST, to the output unit 13, thereby changing the display content of the display 81 in response to the input operation.

The operations of the output unit 13 and the storage unit 14 will be described with reference to FIG. 1. The output unit 13 inputs the dimming control signal SA as a drive signal for the lighting instruments 3 to the dimming devices 2 based on the dimming control signal SA received from the control unit 11. The output unit 13 inputs the display control signal SB as a drive signal for the display 81 to the touch panel 80 based on the display control signal SB received from the control unit 11. The output unit 13 inputs the display control signal SC as a drive signal for the page number display part 61 to the assist controller part 60 based on the display control signal SC received from the control unit 11.

The storage unit 14 stores a program used in the arithmetic processing of the control unit 11, data used in the arithmetic processing of the control unit 11, and data generated by the control unit 11. The storage unit 14 has a function of updating the stored program and data through the connection to an external device. The storage unit 14 has a function of storing a new program and new data through the connection to the external device.

Details of production lighting control will be described with reference to FIGS. 3 to 9. The control unit 11 execute production lighting control in response to the input operation of the touch panel 80. The control unit 11 detects the input operation based on the input detection signal ST. The input operation includes various kinds of operations such as a flick operation, a tap operation, a double-tap operation, a drag operation, a drop operation and a hold operation. The control unit 11 defines the distance from a start position of a flick operation to an end position thereof in one flick operation as a flick amount. The control unit 11 defines the direction running from a start position of a flick operation toward an end position thereof in one flick operation as a flick direction.

In the production lighting control, the control unit 11 executes an instrument setup mode, a scene preparation mode, a playback order editing mode and a scene playback mode. The control unit 11 selects one of the modes in response to the input operation of a menu button 111 (see FIG. 3) of the display 81.

The instrument setup mode includes control on the setting of instrument faders 140 (see FIG. 3) as a virtual fader. The scene preparation mode includes control of the preparation, storage and editing of a scene. The playback order editing mode includes control of the editing of a scene playback order. The scene playback mode includes control on the playback of a scene.

In the instrument setup mode, the control unit 11 executes the following process. The control unit 11 registers and cancels the instrument faders 140 in response to the input operation for a setup menu. In response to the input operation, the control unit 11 has one or more of the lighting instruments 3 associated with the instrument faders 140. The control unit 11 stores the setting information on the instrument faders 140 in the storage unit 14.

In the scene playback mode, the control unit 11 executes the following process. The control unit 11 displays a scene master fader as a virtual fader. In response to the input operation for the scene master fader, the operation of the grand master part 40 or the operation of the physical controller part 50, the control unit 11 plays back the scene corresponding to the operation target part.

The content of the instrument faders 140 will be described. The instrument faders 140 have a function of changing the information of the corresponding lighting instruments 3. Each of the instrument faders 140 includes a level operation part 141, a level display part 142, an instrument name display part 143 and a fader number display part 144.

The level operation part 141 has a function of setting an output level of each of the lighting instruments 3. The level operation part 141 is displayed in the middle portion and the lower end portion of each of the instrument faders 140. The level display part 142 has a function of displaying a numerical value of the output level set in the level operation part 141. The level display part 142 is displayed above the level operation part 141 of each of the instrument faders 140.

The instrument name display part 143 has a function of displaying arbitrary text data set in response to the input operation. The instrument name display part 143 is displayed above the level display part 142 of each of the instrument faders 140.

The fader number display part 144 has a function of displaying an identification number of each of the instrument faders 140 having numbers given in the instrument setup mode. The fader number display part 144 is displayed above the instrument name display part 143 of each of the instrument faders 140.

The content of the scene preparation mode will be described. The scene preparation mode displays the scene preparation information relating to the scene preparation on the display 81 on a program-by-program basis. The scene preparation mode has a function of switching programs to be prepared. The scene preparation mode displays the information on the scene constituting one program on a scene preparation screen 100. The scene preparation mode prepares and stores the information on the scene in response to the operator's input operation of the scene preparation screen 100. The scene preparation mode displays a plurality of instrument faders 140 on the scene preparation screen 100. The scene preparation mode prepares a scene mainly in response to the input operation of each of the instrument faders 140.

The scene preparation screen 100 includes a function display region 110, a scene preparation region 120 and a scene storage region 130. The scene preparation screen 100 displays the function display region 110 at the uppermost section in the height direction. The scene preparation screen 100 displays the scene preparation region 120 at the lower side of the of the function display region 110. The scene preparation screen 100 displays the scene storage region 130 at the lower side of the scene preparation region 120. The scene preparation information includes the information displayed in the function display region 110, the scene preparation region 120 and the scene storage region 130.

The function display region 110 has various kinds of functions regarding the preparation of a scene. The function display region 110 includes a menu button 111, a first instrument display mode switching part 112, a second instrument display mode switching part 113, a first operation function switching part 114, a second operation function switching part 115, an in-playback editing button 116 and a scene storing button 170.

The first instrument display mode switching part 112 has a function of switching the display content of the instrument faders 140 in the scene preparation region 120. The first instrument display mode switching part 112 includes a normal mode and a group mode. The first instrument display mode switching part 112 has the normal mode as a default value.

The normal mode displays the non-grouped individual instrument faders 140 in the scene preparation region 120. The group mode displays the grouped instrument faders 140 in the scene preparation region 120. The scene preparation screen 100 shown in FIG. 3 displays a state in which the normal mode is selected. The term "Normal" in FIG. 3 indicates the normal mode. The term "Group" in FIG. 3 indicates the group mode.

The second instrument display mode switching part 113 has a function of switching the displayed number of the instrument faders 140 in the scene preparation region 120. The second instrument display mode switching part 113 includes a one-stage display mode and a three-stage display mode. The second instrument display mode switching part 113 has the one-stage display mode as a default value.

The one-stage display mode sets the displayed stage number of the instrument faders 140 in the scene preparation region 120 as one stage. The three-stage display mode sets the displayed stage number of the instrument faders 140 in the scene preparation region 120 as three stages. The scene preparation screen 100 shown in FIG. 3 displays a state in which the one-stage display mode is selected. The term "One Stage" in FIG. 3 indicates the one-stage display mode. The term "Three Stages" in FIG. 3 indicates the three-stage display mode.

The first operation function switching part 114 has a function of switching the reception state of the input operation regarding the storage of a scene. The first operation function switching part 114 includes a storage permitting mode and a storage limiting mode. The first operation function switching part 114 has the storage permitting mode as a default value.

When the input operation for storing a scene is performed, the storage permitting mode permits the storage of the scene based on the input operation. When the input operation for playing back the stored scene is performed, the storage permitting mode permits the playback of the scene based on the input operation. When the input operation for storing a scene is performed, the storage limiting mode inhibits the storage of the scene based on the input operation. When the input operation for playing back the stored scene is performed, the storage limiting mode permits the playback of the scene based on the input operation. The scene preparation screen 100 shown in FIG. 3 displays a state in which the storage permitting mode is selected. The term "Record" in FIG. 3 indicates the storage permitting mode. The term "Play" in FIG. 3 indicates the storage limiting mode.

The second operation function switching part 115 has a function of switching the reception state of the input operation for the instrument faders 140. The second operation function switching part 115 includes a protect-invalidating mode and a protect-validating mode. The second operation function switching part 115 has the protect-invalidating mode as a default value.

When the input operation for the instrument faders 140 is performed, the protect-invalidating mode permits the input operation to be reflected in the instrument faders 140. When the input operation for the instrument faders 140 is performed, the protect-validating mode inhibits the input operation from being reflected in the instrument faders 140. The scene preparation screen 100 shown in FIG. 3 displays a state in which the protect-invalidating mode is selected. The term "Live" in FIG. 3 indicates the protect-invalidating mode. The term "Protect" in FIG. 3 indicates the protect-validating mode.

The in-playback editing button 116 has a function of editing a scene based on the input operation for the instrument faders 140 during the playback of the scene. The in-playback editing button 116 includes an in-playback editing monitoring mode and an in-playback editing reception mode. The in-playback editing button 116 includes an editing monitoring display state and an editing reception display state.

The in-playback editing button 116 makes the display colors of buttons in the editing monitoring display state and the editing reception display state differ from each other, thereby creating the editing monitoring display state or the editing reception display state. The in-playback editing button 116 creates the editing monitoring display state during the in-playback editing monitoring mode. The in-playback editing button 116 creates the editing reception display state during the in-playback editing reception mode. The in-playback editing button 116 has the in-playback editing monitoring mode as a default value.

The in-playback editing button 116 is shifted to the in-playback editing reception mode when the input operation for the instrument faders 140 is performed during the playback of the scene. During the in-playback editing reception mode, the in-playback editing button 116 receives the editing of the scene performed in response to the input operation for the instrument faders 140. The in-playback editing button 116 stores the content of the edited scene when the input operation for the in-playback editing button 116 is performed in the in-playback editing reception mode.

The scene preparation region 120 includes all the instrument faders 140 registered in the instrument setup mode. The scene preparation region 120 manages the respective instrument faders 140 by arranging the instrument faders 140 side by side in one row or three rows along the width direction of the display 81. The scene preparation region 120 manages the arrangement of the instrument faders 140 as a fader page 120A. The scene preparation screen 100 shown in FIG. 3 displays a state in which the fader page 120A is set in one row.

The scene preparation region 120 defines the number of the instrument faders 140 as a registered instrument fader number FA. The scene preparation region 120 defines the number of the instrument faders 140 displayed on the scene preparation screen 100 at one time as a displayed instrument fader number FB. The scene preparation region 120 has "10" as one example of a default value of the displayed instrument fader number FB in the one-stage display mode. The scene preparation region 120 has "30" as one example of a default value of the displayed instrument fader number FB in the three-stage display mode. The scene preparation screen 100 shown in FIG. 3 displays a state in which the displayed instrument fader number FB is set at "10".

The scene preparation region 120 displays a portion of the fader page 120A when the registered instrument fader number FA is larger than the displayed instrument fader number FB. When displaying a portion of the fader page 120A, the scene preparation region 120 displays the same number of the instrument faders 140 as the displayed instrument fader number FB. The scene preparation region 120 displays the entirety of the fader page 120A when the registered instrument fader number FA is smaller than the displayed instrument fader number FB or when the registered instrument fader number FA is equal to the displayed instrument fader number FB. The scene preparation screen 100 shown in FIG. 3 displays a state in which a portion of the fader page 120A is displayed.

The scene storage region 130 includes a plurality of executors 150. The scene storage region 130 manages the executors 150 by arranging the executors 150 side by side in one row along the width direction of the display 81. The scene storage region 130 manages the arrangement of the executors 150 as an executor rank 130A. The scene storage region 130 includes the same number of the executors 150 as the number of the physical faders 51 (see FIG. 2). That is to say, the scene storage region 130 includes "12" executors 150. The scene storage region 130 defines the number of the executors 150 displayed on the scene preparation screen 100 at one time as a displayed executor number EX. The scene storage region 130 has a number equal to the number of the physical faders 51 as a default value of the displayed executor number EX. The scene preparation screen 100 shown in FIG. 3 displays a state in which the displayed executor number EX is set at "12".

The scene storage region 130 has a function of registering scene icons 160 and a function of generating, displaying and editing scene playback order information. The scene storage region 130 displays the registered scene icons 160 on the executors 150. The scene storage region 130 manages the respective scene icons 160 by arranging the scene icons 160 side by side in one row. The scene storage region 130 manages the arrangement of the scene icons 160 as a scene rank 130B. The scene storage region 130 manages the scene playback order defined by the scene rank 130B as scene playback order information in one program. That is to say, the scene rank 130B indicates a scene playback order in one program using the arrangement of the scene icons 160. The scene storage region 130 changes the arrangement order of the scene icons 160 in the scene rank 130B in response to the input operation for the scene rank 130 B. The scene storage region 130 displays the scene playback order information in one program by displaying the scene icons 160 in the scene rank 130B according to the playback order.

The scene storage region 130 defines the number of all the scene icons 160 constituting the scene rank 130B as a registered scene number CA. The scene storage region 130 defines the number of the scene icons 160 displayed on the scene preparation screen 100 at one time as a displayed scene number CB. The scene storage region 130 has "0" as one example of a default value of the displayed scene number CB. The scene preparation screen 100 shown in FIG. 3 displays a state in which the displayed instrument fader number FB is set at "11". The scene preparation screen 100 shown in FIG. 3 displays a blank executor 150 at the right end of the executor rank 130A.

The scene storage region 130 displays a portion of the scene rank 130B when the registered scene number CA is larger than the displayed scene number CB. When displaying a portion of the scene rank 130B, the scene storage region 130 displays the same number of the scene icons 160 as the number of the displayed scene number CB. The scene storage region 130 displays the entirety of the scene rank 130B when the registered scene number CA is smaller than the displayed scene number CB or when the registered scene number CA is equal to the displayed scene number CB. The scene preparation screen 100 shown in FIG. 3 displays a state in which the entirety of the scene rank 130B is displayed.

Each of the executors 150 has a function of controlling the physical fader 51 as a programmable fader. Each of the executors 150 has a plurality of soft fader functions allotted to the physical fader 51. Each of the executors 150 sets one function selected from the soft fader functions by an input operation. Each of the executors 150 has a function of comprehensively or individually selecting the soft fader functions.

Each of the executors 150 has, as one of example of the soft fader functions, a cross fader function, a move fader function, a scene fader function, a scene master fader function, a group master fader function and a free fader function. Each of the executors 150 has the scene master fader function as a default value of the soft fader functions.

The physical fader 51 serves as a fader identical with the cross fader of an ordinary dimming console when the cross fader function is set in each of the executors 150. The physical fader 51 serves as a fader identical with the move fader of an ordinary dimming console when the move fader function is set in each of the executors 150. The physical fader 51 serves as a fader identical with the scene fader of an ordinary dimming console when the scene fader function is set in each of the executors 150.

The physical fader 51 serves as a fader identical with the scene mater fader of an ordinary dimming console when the scene master fader function is set in each of the executors 150. The physical fader 51 serves as a fader identical with the group fader of an ordinary dimming console when the group master fader function is set in each of the executors 150. The physical fader 51 serves as a fader identical with the free fader of an ordinary dimming console when the free fader function is set in each of the executors 150. The ordinary dimming console refers to a preset-type dimming console or a memory-type dimming console.

Each of the executors 150 includes a state display part 151. Each of the executors 150 displays the state display part 151 when the soft fader functions are set. Each of the executors 150 does not display the state display part 151 when the soft fader functions are not set. The scene preparation screen 100 shown in FIG. 3 displays a state in which the soft fader functions are not set in the executor 150 existing at the right end of the executor rank 130A.

The state display part 151 displays the operation state of the corresponding physical fader 51, the state of the scene played back by the corresponding physical fader 51, and so forth. The content displayed in the state display part 151 is set depending on the soft fader functions set in each of the executors 150.

Each of the scene icons 160 includes a scene number display part 161 and a scene name display part 162. The scene number display part 161 displays the number which is given each time when each of the scene icons 160 is generated. The scene name display part 162 displays arbitrary text information set by an input operation. The scene name display part 162 displays a default value when each of the scene icons 160 is generated.

Description will be made on the detailed operation of the control unit 11 in the scene preparation mode. When a tap operation for the menu button 111 is detected, the control unit 11 displays a basic menu of production lighting control. When an input operation of selecting an item of the basic menu is detected in a state in which the basic menu is displayed, the control unit 11 displays the information corresponding to the selected item on the display 81.

Upon detecting a tap operation for the first instrument display mode switching part 112, the control unit 11 switches the normal mode and the group mode by a toggle method. When the normal mode is selected, the control unit 11 displays the non-grouped instrument faders 140 in the scene preparation region 120. When the group mode is selected, the control unit 11 displays the grouped instrument faders 140 in the scene preparation region 120.

Upon detecting a tap operation for the second instrument display mode switching part 113, the control unit 11 switches the one-stage display mode and the three-stage display mode by a toggle method. When the one-stage display mode is selected, the control unit 11 displays the fader page 120A of one stage in the scene preparation region 120. When the three-stage display mode is selected, the control unit 11 displays the fader page 120A of three stages in the scene preparation region 120.

Upon detecting a tap operation for the first operation function switching part 114, the control unit 11 switches the storage permitting mode and the storage limiting mode by a toggle method. When the storage permitting mode is selected, the control unit 11 starts to store the scene in response to the input operation for the scene storing button 170. When the storage limiting mode is selected, the control unit 11 cancel the detection result of the input operation for the scene storing button 170.

Upon detecting a tap operation for the second operation function switching part 115, the control unit 11 switches the protect-invalidating mode and the protect-validating mode by a toggle method. When the protect-invalidating mode is selected, the control unit 11 changes the setting information of the instrument faders 140 in response to the input operation for the instrument faders 140. When the protect-validating mode is selected, the control unit 11 cancels the detection result of the input operation for the instrument faders 140.

Upon detecting an input operation for the instrument faders 140 during the scene playback in a state in which the in-playback editing monitoring mode of the in-playback editing button 116 is selected, the control unit 11 changes the display state of the in-playback editing button 116 to an editing reception display state. Upon detecting this input operation, the control unit 11 converts the mode of the in-playback editing button 116 from the in-playback editing monitoring mode to the in-playback editing reception mode. When the in-playback editing reception mode is selected, the control unit 11 receives the editing of the scene pursuant to the input operation for the instrument faders 140. Upon detecting an input operation for the in-playback editing button 116 in a state in which the in-playback editing reception mode is selected, the control unit 11 stores the content of the edited scene.

If the edited scene is stored in a state in which the in-playback editing reception mode of the in-playback editing button 116 is selected, the control unit 11 changes the display state of the in-playback editing button 116 to an editing monitoring display state. When the same scene is stored, the control unit 11 converts the mode of the in-playback editing button 116 from the in-playback editing reception mode to the in-playback editing monitoring mode.

Upon detecting a flick operation for the scene preparation region 120, the control unit 11 changes the display of the fader page 120A on a fader basis or on a page basis depending on the flick direction and the flick amount. The control unit 11 defines one instrument fader 140 as a unit of a scroll amount of the fader page 120A, sets a scroll amount corresponding to the flick amount and scrolls the display of the fader page 120A pursuant to the scroll amount thus set.

Upon detecting a flick operation whose flick direction is rightward and whose flick amount is equal to or larger than a page switching amount, the control unit 11 changes the displayed page of the fader page 120A to the next page. Upon detecting a flick operation whose flick direction is rightward and whose flick amount is smaller than a page switching amount, the control unit 11 scrolls the fader page 120A rightward. Up on detecting a flick operation whose flick direction is leftward whose flick amount is equal to or larger than a page switching amount, the control unit 11 changes the displayed page of the fader page 120A to the previous page. Upon detecting a flick operation whose flick direction is leftward and whose flick amount is smaller than a page switching amount, the control unit 11 scrolls the fader page 120A leftward.

Upon detecting a drag operation for the instrument fader 140, the control unit 11 moves the relevant instrument fader 140. Upon detecting a drop operation for the instrument fader 140, the control unit 11 inserts the instrument fader 140 into the position of the fader page 120A corresponding to the drop operation.

The control unit 11 reflects the setting level of the level operation part 141 to the output level of each of the lighting instruments 3. Upon detecting a flick operation for the level operation part 141, the control unit 11 changes the setting level of the level operation part 141 depending on the flick direction and the flick amount.

Upon detecting a flick operation whose flick direction is upward, the control unit 11 increases the setting level of level operation part 141. Upon detecting a flick operation whose flick direction is downward, the control unit 11 reduces the setting level of level operation part 141. The control unit 11 sets a change amount of the setting level depending on the flick amount. The scene preparation screen 100 shown in FIG. 3 displays a state in which the setting level of the level operation part 141 is not changed. The scene preparation screen 100 shown in FIG. 4 displays a state in which the setting level of the level operation part 141 is changed.

Upon detecting a tap operation for the level display part 142, the control unit 11 displays a color library (not shown) of each of the lighting instruments 3. The control unit 11 manages a color selected from the color library as a setting color. The control unit 11 reflects the setting color to the output level of each of the lighting instruments 3.

Upon detecting a tap operation for the instrument name display part 143, the control unit 11 displays an instrument name input part (not shown). The control unit 11 manages the text data inputted through the instrument name input part as a setting name. The control unit 11 has the setting name displayed in the instrument name display part 143.

In response to the operation of the physical controller part 50, the control unit 11 plays back a scene as follows. Upon detecting the operation of the physical fader 51, the control unit 11 plays back one scene corresponding to the physical fader 51.

The control unit 11 defines a scene corresponding to the physical fader 51 based on the correspondence relationship between the executor 150 and the physical fader 51. The control unit 11 defines the scene associated with the scene icon 160 displayed on the executor 150 as a playback target scene of the physical fader 51 corresponding to the same executor 150. For that reason, when the physical fader 51 is operated, the scene is played back based on the scene information included in the scene icon 160 on the executor 150 corresponding to the physical fader 51.

The control unit 11 scrolls the scene icon 160 on the executor rank 130A. Thus, the scene corresponding to the physical fader 51 is changed in response to the scroll of the scene icon 160.

The control unit 11 has the same executor 150 associated with the physical fader 51 and the physical button 52 that constitute the physical controller part 50. Thus, the physical fader 51 and the physical button 52 are associated with the same scene.

A scene storing method will be described with reference to FIGS. 3 to 7. The control unit 11 stores a scene through the operations illustrated in FIGS. 3 to 7. The scene preparation screen 100 shown in FIG. 3 displays a state in which the setting information of each of the instrument faders 140 regarding one scene is not inputted. The scene preparation screen 100 shown in FIG. 4 displays a state in which the setting information of each of the instrument faders 140 regarding one scene is inputted. The scene preparation screen 100 shown in FIG. 5 displays a state in which the input operation for storing a scene is started. The scene preparation screen 100 shown in FIG. 6 displays an intermediate state in which the input operation for storing a scene is in progress. The scene preparation screen 100 shown in FIG. 7 displays a state in which the scene is stored.

Figure 3:
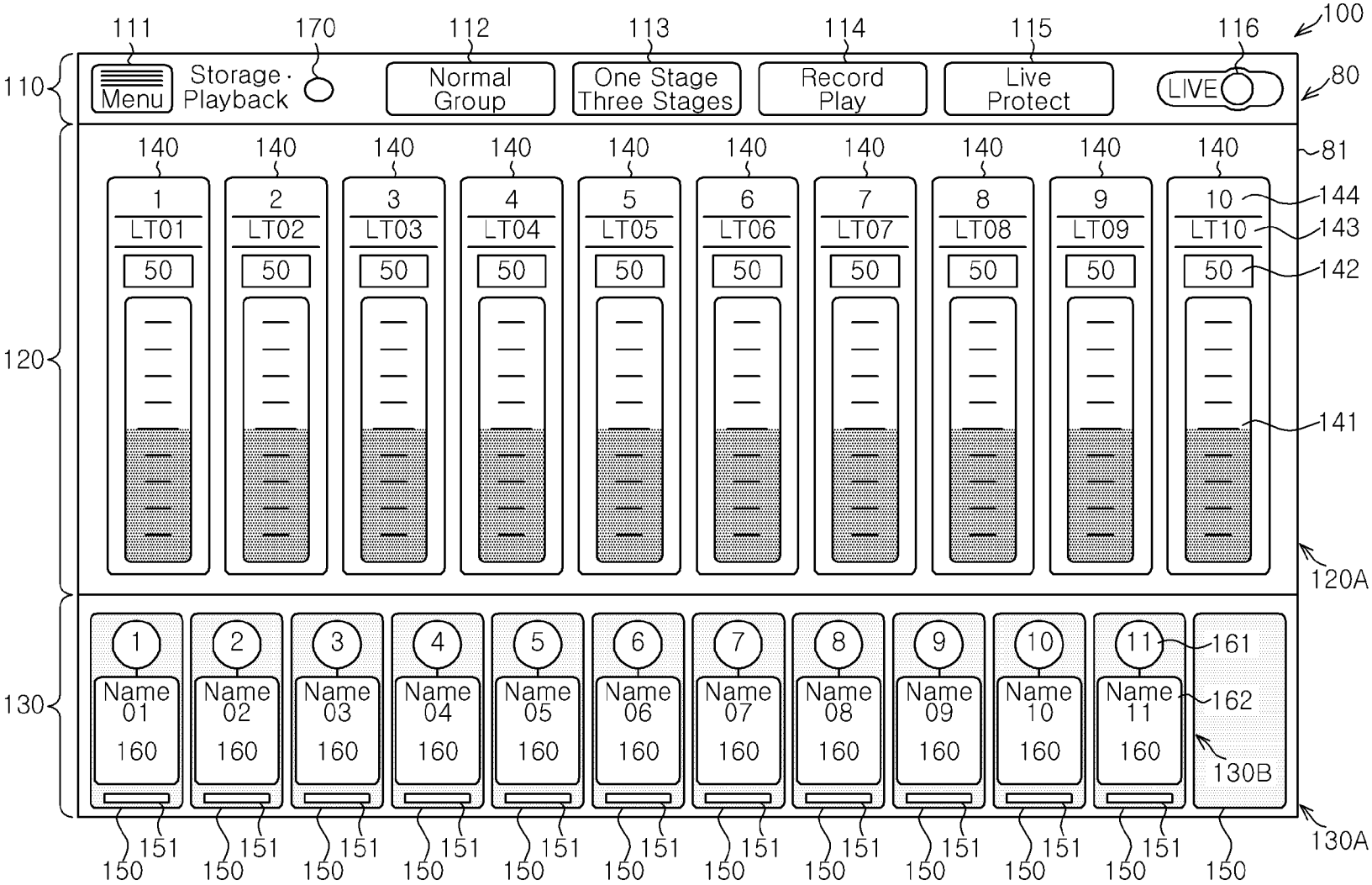
FIG. 3 is a front view illustrating one example of a scene preparation screen according to the embodiment.
Figure 4:
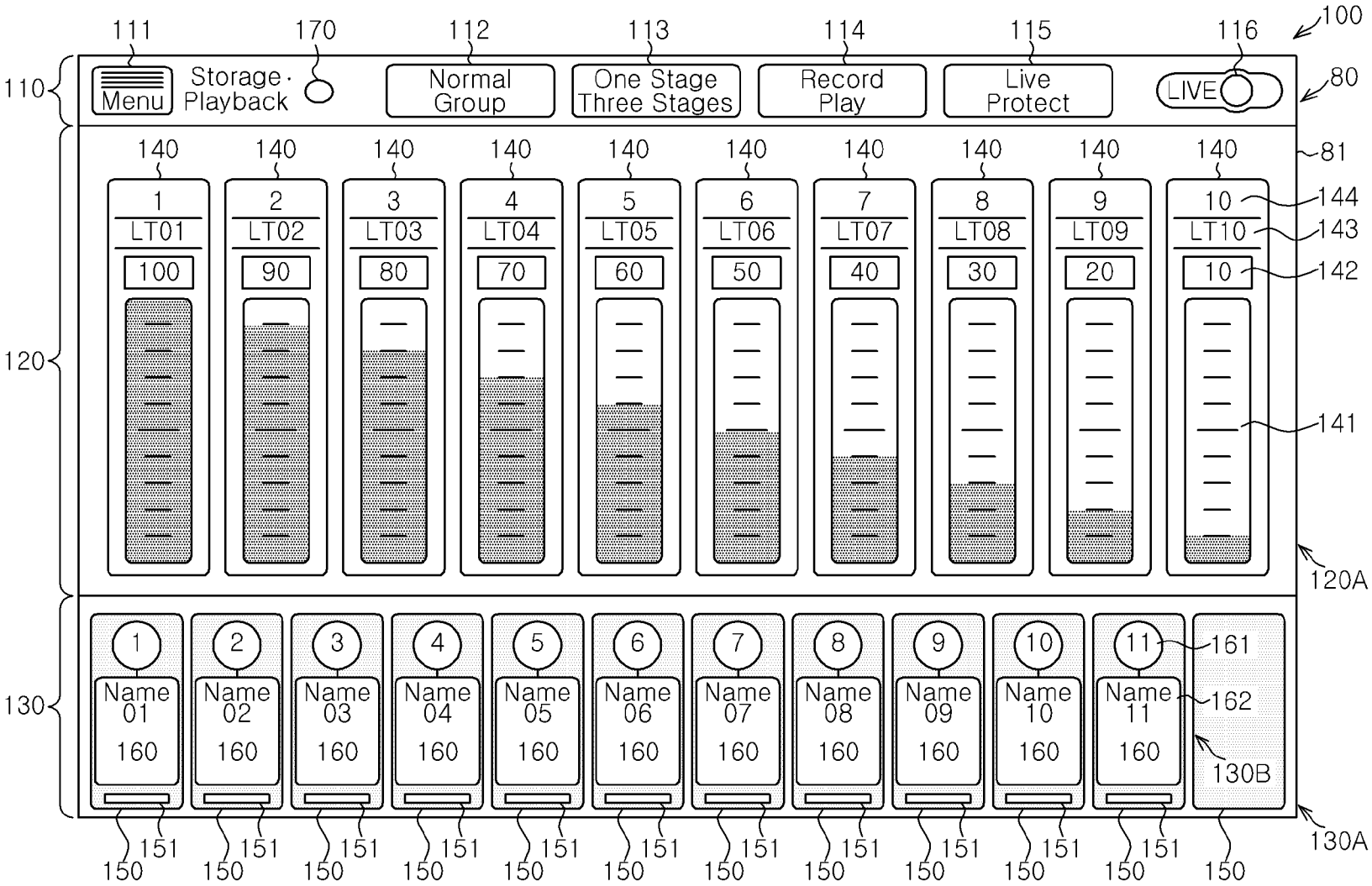
FIG. 4 is a front view illustrating another example of the scene preparation screen according to the embodiment.

As the input of the setting information of each of the instrument faders 140 is finished, the content displayed on the scene preparation screen 100 is changed from the content illustrated in FIG. 3 to the content illustrated in FIG. 4. In response to the input operation for the scene storing button 170, the content displayed on the scene preparation screen 100 is changed from the content illustrated in FIG. 4 to the content illustrated in FIG. 5. In response to the input operation of registering the scene icon 160 in the scene storage region 130, the content displayed on the scene preparation screen 100 is changed from the content illustrated in FIG. 5 to the content illustrated in FIG. 6 and then the content illustrated in FIG. 7.

Figure 5:
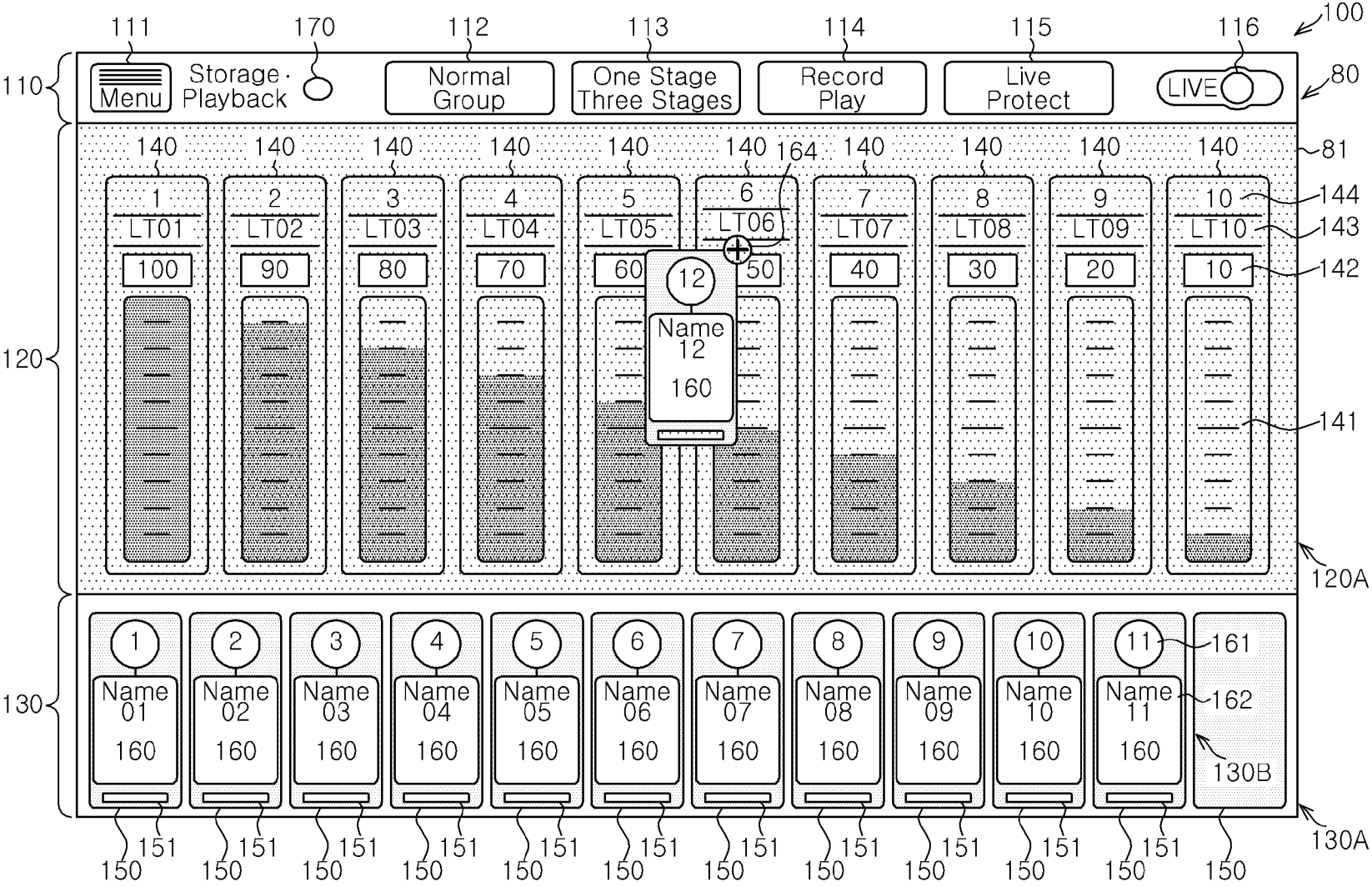
FIG. 5 is a front view illustrating a further example of the scene preparation screen according to the embodiment.

The control unit 11 executes the following process in respect of the storage of a scene. Upon detecting a tap operation for the scene storing button 170 in a state in which the scene preparation screen 100 illustrated in FIG. 4 is displayed, the control unit 11 generates scene information on one scene under preparation. Upon detecting a tap operation for the scene storing button 170, the control unit 11 displays a scene icon 160 and a registration-in-progress indicating image 164 in the scene preparation region 120 as illustrated in FIG. 5.

The control unit 11 manages the scene information and the scene icon 160 by associating them with each other. When the scene icon 160 and the registration-in-progress indicating image 164 are displayed, the control unit 11 makes the brightness of the scene preparation region 120 darker than the brightness of the function display region 110 and the scene storage region 130. The registration-in-progress indicating image 164 indicates a state in which the target scene icon 160 can be registered in the scene storage region 130.

The scene information includes instrument setting information and cue information. The instrument setting information includes the setting information of each of the instrument faders 140 regarding one scene. The setting information of each of the instrument faders 140 includes the setting level of the level operation part 141, the setting color of the level display part 142, the setting instrument name of the instrument name display part 143, and the setting number of the fader number display part 144.

The cue information includes a wait time, a fade time and a delay time for one scene. The wait time refers to the start time of the present scene determined based on the start time of the previous scene. The fade time refers to the time required for the output level of the lighting instruments 3 to reach the maximum output level of the present scene after the start of the present scene. The delay time refers to the time during which the start time of the present scene determined by the wait time is delayed.

Figure 6:
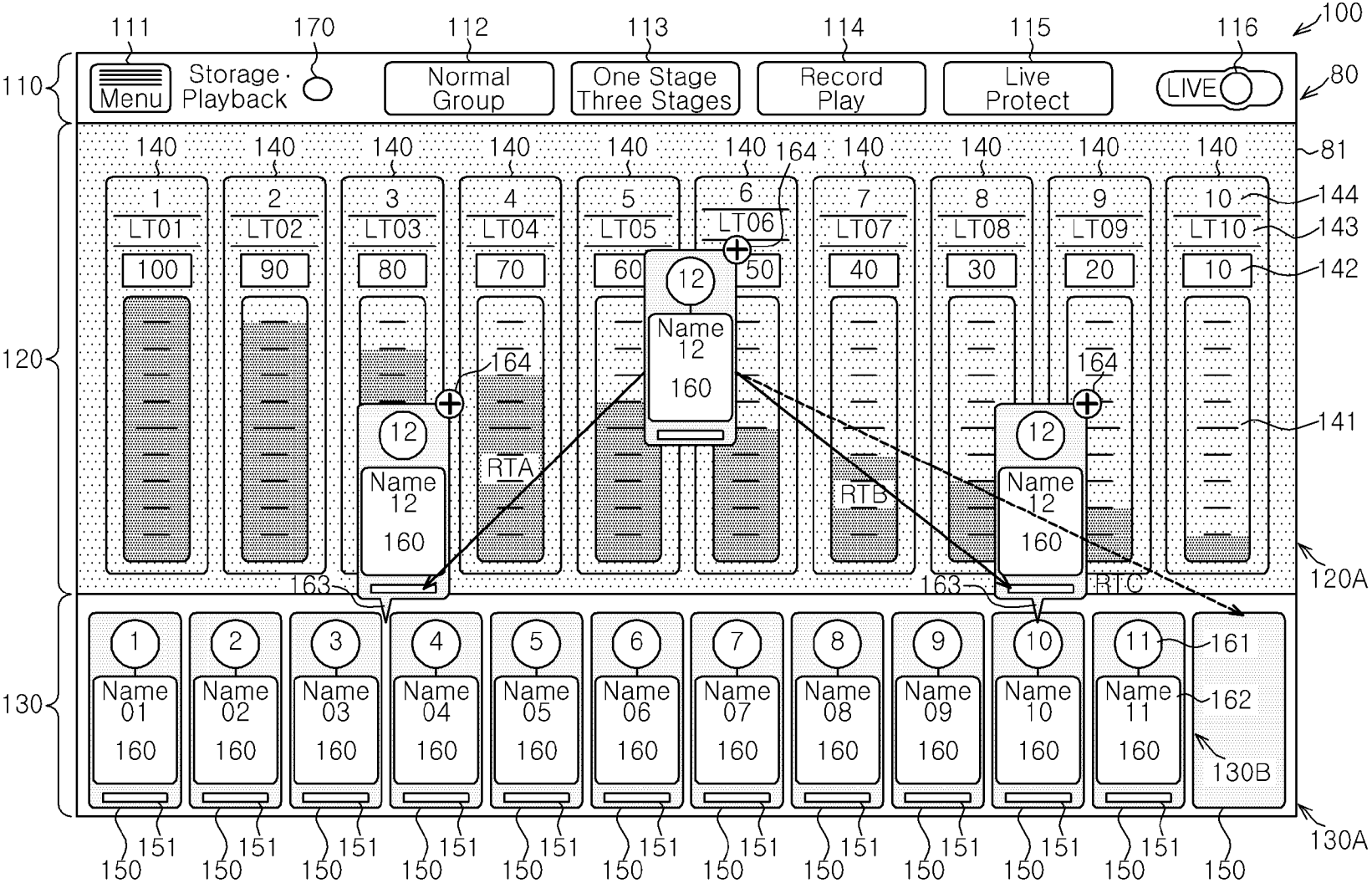
FIG. 6 is a front view illustrating a still further example of the scene preparation screen according to the embodiment.
Figure 7:
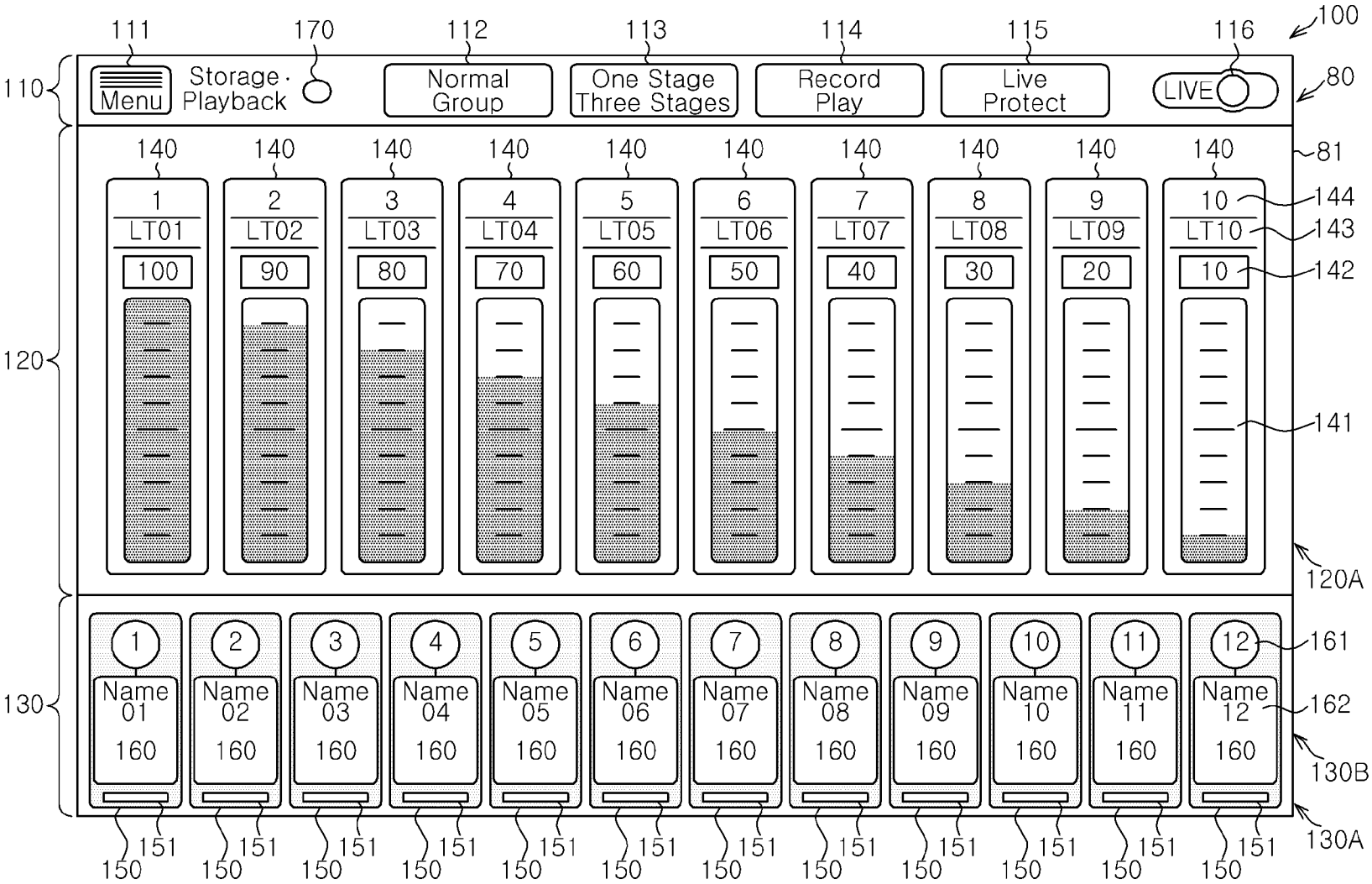
FIG. 7 is a front view illustrating a yet still further example of the scene preparation screen according to the embodiment.

Upon detecting an input operation for the scene icon 150 in a state in which the scene preparation screen 100 illustrated in FIG. 5 is displayed, the control unit 11 registers the scene icon 160 in the scene storage region 130 by a method according to the input operation as illustrated in FIG. 6. The control unit 11 includes a first scene registration method, a second scene registration method and a third scene registration method, as methods for registering the scene icon 160 in the scene storage region 130.

The first scene registration method is a method for newly registering a scene icon 160 between two scene icons 160 registered in the scene storage region 130. An arrow RTA in FIG. 6 indicates one example of a route of the scene icon 160 when the scene icon 160 is registered in the scene rank 130B by the first scene registration method.

The control unit 11 registers the scene icon 160 in the following manner using the first scene registration method. Upon detecting a drag operation of the scene icon 160, the control unit 11 moves the scene icon 160 and the registration-in-progress indicating image 164 along the route of the drag operation. Upon detecting a drag operation by which a new scene icon 160 is moved to between the scene icons 160 of the scene rank 130B, the control unit 11 moves the scene icon 160 to the vicinity of a target region of the scene rank 130B (see an arrow RTA). The control unit 11 moves the scene icon 160 and the registration-in-progress indicating image 164 together until the scene icon 160 is registered in the scene storage region 130.

When the scene icon 160 is moved to the vicinity of the scene rank 130B, the control unit 11 displays a registration destination guide image 163 which indicates an intended insertion position in the scene rank 130B. Upon detecting a drop operation of the scene icon 160 in a state in which the registration destination guide image 163 is displayed, the control unit 11 inserts the scene icon 160 into the intended insertion position designated by the registration destination guide image 163. By inserting the scene icon 160 into the scene rank 130B, the control unit 11 registers the scene icon 160 in the scene storage region 130.

The second scene registration method is a method for overwriting a new scene icon 160 on the scene icon 160 registered in the scene storage region 130. An arrow RTB in FIG. 6 indicates one example of a route of the scene icon 160 when the scene icon 160 is registered in the scene rank 130B by the second scene registration method.

The control unit 11 registers the scene icon 160 in the following manner using the second scene registration method. Upon detecting a drag operation of the scene icon 160, the control unit 11 moves the scene icon 160 and the registration-in-progress indicating image 164 along the route of the drag operation. Upon detecting a drag operation by which a new scene icon 160 is moved onto the scene icon 160 of the scene rank 130B, the control unit 11 moves the scene icon 160 to the vicinity of a target region of the scene rank 130B (see an arrow RTB). The control unit 11 moves the scene icon 160 and the registration-in-progress indicating image 164 together until the scene icon 160 is registered in the scene storage region 130.

When the scene icon 160 is moved to the vicinity of the scene rank 130B, the control unit 11 displays a registration destination guide image 163 which indicates an intended overwrite position in the scene rank 130B. Upon detecting a drop operation of the scene icon 160 in a state in which the registration destination guide image 163 is displayed, the control unit 11 inserts the scene icon 160 into the intended overwrite position designated by the registration destination guide image 163. By overwriting a new scene icon 160 onto the scene icon 160 of the scene rank 130B, the control unit 11 registers the scene icon 160 in the scene storage region 130.

The third scene registration method is a method for registering a newly generated scene icon 160 at the end of the scene rank 130B. An arrow RTC in FIG. 6 indicates one example of a route of the scene icon 160 when the scene icon 160 is registered in the scene rank 130B by the third scene registration method.

The control unit 11 registers the scene icon 160 in the following manner using the third scene registration method. Upon detecting a double-tap operation of the scene icon 160, the control unit 11 registers the scene icon 160 at the end of the scene rank 130B (see the arrow RTC). By registering a new scene icon 160 at the end of the scene rank 130B, the control unit 11 registers the scene icon 160 in the scene storage region 130.

When the scene icon 160 is registered in the scene storage region 130 by one of the first to third scene registration methods as shown in FIG. 1, the control unit 11 stores the scene information corresponding to the registered scene icon 160 in the storage unit 14. The control unit 11 stores the scene information in a storage region of the storage unit 14 differing from a backup region. When the scene icon 160 is registered in the scene storage region 130, the control unit 11 change the brightness of the scene preparation region 120 to the same brightness as that of the function display region 110 and the scene storage region 130.

Based on the scene playback order defined by the scene rank 130B, the control unit 11 generates program playback information as playback order information and stores the generated program playback information in the storage unit 14. The control unit 11 updates the program playback information each time when the arrangement of the scene icons 160 in the scene rank 130B is updated. The program playback information is generated as the playback order information having a data format which can be stored in the storage unit 14. The program play back information constitutes scene playback order information used when one program is played back in the scene playback mode.

In response to a drag operation of the scene icon 160 which constitutes the scene rank 130B, the control unit 11 changes the arrangement order of the scene icons 160 in the scene rank 130B. That is to say, the control unit 11 edits the scene playback order information in response to the drag operation of the scene icon 160. Upon detecting the drag operation of the scene icon 160 of the scene rank 130B, the control unit 11 moves the scene icon 160 along the route of the drag operation. Upon detecting a drop operation of the scene icon 160, the control unit 11 inserts the drop operation target scene icon 160 into between the scene icons 160 which constitute the scene rank 130B.

The content of the playback order editing mode will be described with reference to FIGS. 8 and 9. The playback order editing mode displays a playback order editing screen 200 on the display 81. The playback order editing screen 200 includes playback order editing information relating to the editing of a scene playback order.

The playback order editing mode displays the scene information relating to all the programs on the playback order editing screen 200. In response to the operator's input operation for the playback order editing screen 200, the playback order editing mode edits and stores the scene playback order information on a program-by-program basis. The playback order editing mode includes a simplified scene display mode and a detailed scene display mode. The simplified scene display mode displays the playback order editing screen 200 illustrated in FIG. 8. The detailed scene display mode displays the playback order editing screen 200 illustrated in FIG. 9.

The playback order editing screen 200 includes a function display region 210, a scene list display region 220, a play back order display region 230 and a list display region 240. The playback order editing screen 200 has the function display region 210 disposed at the uppermost section in the height direction. The playback order editing screen 200 has the scene list display region 220 disposed below the function display region 210. The playback order editing screen 200 has the playback order display region 230 disposed below the scene list display region 220. The playback order editing screen 200 has the list display region 240 disposed below the playback order display region 230.

The list display region 240 has a function of displaying one or more list icons 241. The list display region 240 manages one kind of program playback information generated in the scene preparation mode and one list icon 241 by associating them with each other. That is to say, one list icon 241 includes the information that defines a flow of scenes from the first scene to the last scene in one program.

Figure 8:
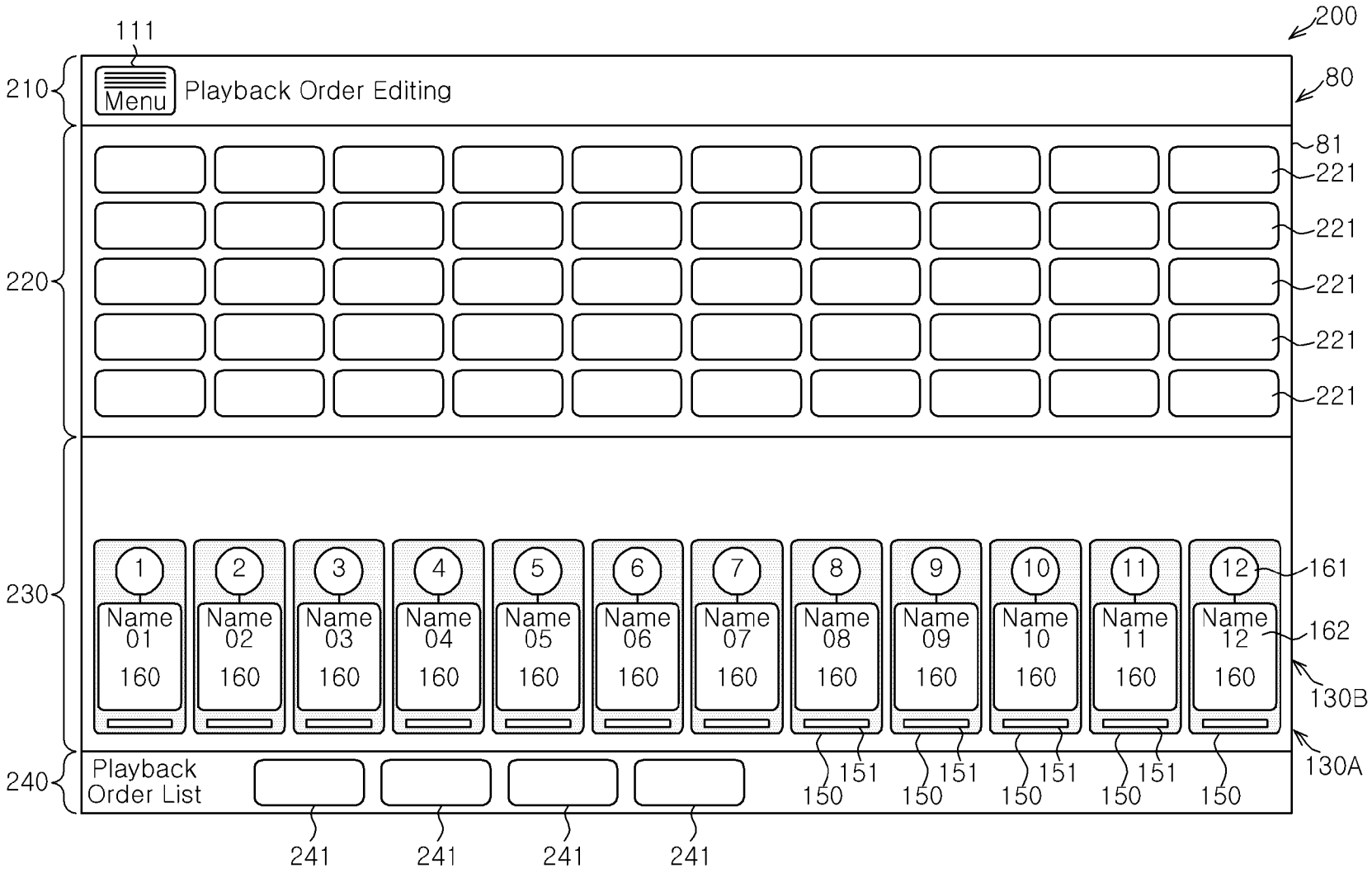
FIG. 8 is a front view illustrating one example of a playback order editing screen.

In the simplified scene display mode illustrated in FIG. 8, the scene list display region 220 displays the scene icon 160 registered in the scene preparation mode by changing the display format of the scene icons 160. In the simplified scene display mode, the scene list display region 220 displays the scene icons 160 as simplified scene icons 221.

The scene list display region 220 defines the total number of the scene icons 160 of each of the programs as a total program registration scene number CC. The scene list display region 220 defines the number of simplified scene icons 221 displayed at one time in the simplified scene display mode as a simply displayed scene number CD. The scene list display region 220 has "0" as one example of a default value of the simply displayed scene number CD. The playback order editing screen 200 shown in FIG. 8 displays a state in which the simply displayed scene number CD is set at "50".

If the total program registration scene number CC is larger than the simply displayed scene number CD, the scene list display region 220 will display some of the simplified scene icons 221 of the total programs. When displaying some of the simplified scene icons 221 of the total programs, the scene list display region 220 displays the same number of the simplified scene icons 221 as the simply displayed scene number CD.

If the total program registration scene number CC is smaller than the simply displayed scene number CD or if the total program registration scene number CC is equal to the simply displayed scene number CD, the scene list display region 220 will display all the simplified scene icons 221. The playback order editing screen 200 shown in FIG. 8 displays a state in which some of the simplified scene icons 221 of the total programs are displayed.

Figure 9:
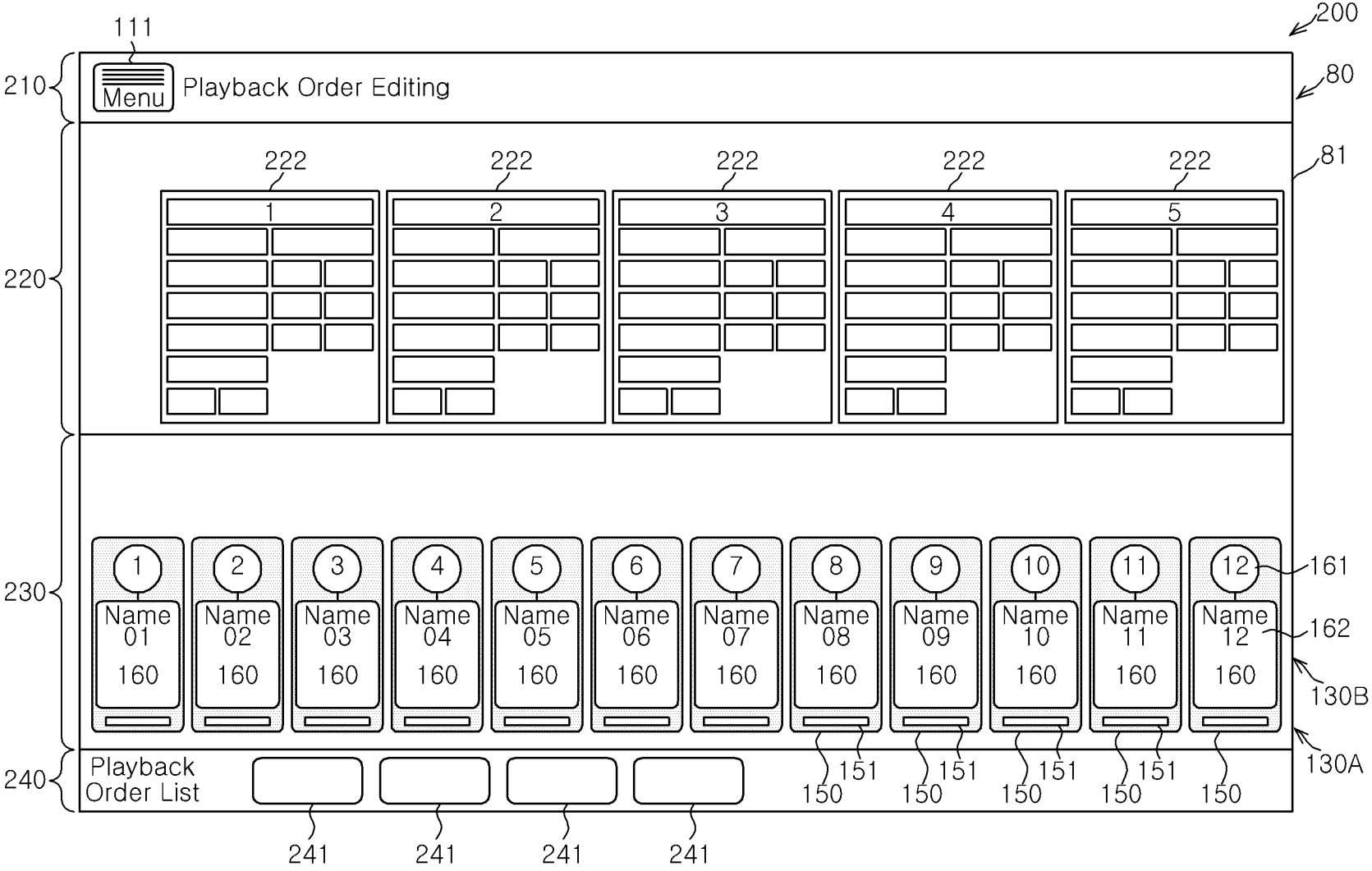
FIG. 9 is a front view illustrating another example of a playback order editing screen.

In the detailed scene display mode illustrated in FIG. 9, the scene list display region 220 displays the scene icons 160 registered in the scene preparation mode by changing the display format of the scene icons 160. In the detailed scene display mode, the scene list display region 220 displays the scene icons 160 as detailed scene icons 222.

The scene list display region 220 defines the number of detailed scene icons 222 displayed at one time in the detailed scene display mode as a minutely displayed scene number CE. The scene list display region 220 has "0" as one example of a default value of the minutely displayed scene number CE. The playback order editing screen 200 shown in FIG. 9 displays a state in which the minutely displayed scene number CE is set at "5".

If the total program registration scene number CC is larger than the minutely displayed scene number CE, the scene list display region 220 will display some of the detailed scene icons 222 of the total programs. When displaying some of the detailed scene icons 222, the scene list display region 220 displays the same number of the detailed scene icons 222 as the minutely displayed scene number CE.

If the total program registration scene number CC is smaller than the minutely displayed scene number CE or if the total program registration scene number CC is equal to the minutely displayed scene number CE, the scene list display region 220 will display all the detailed scene icons 222. The playback order editing screen 200 shown in FIG. 9 displays a state in which some of the detailed scene icons 222 of the total programs are displayed.

The playback order display region 230 has a function of displaying the scene icons 160 and a function of displaying the scene playback order information. The playback order display region 230 has a function of displaying a program playback order associated with the list icons 241 selected in the list display region 240. In addition to these functions, the playback order display region 230 further has the same functions as those of the scene storage region 130 of the scene preparation mode.

The content of the simplified scene display mode will be described with reference to FIG. 8. When the playback order editing screen 200 illustrated in FIG. 8 is displayed on the display 81, the control unit 11 performs a process relating to the editing of a scene playback order in the following manner. Upon detecting an input operation for the simplified scene icons 221, the control unit 11 registers the simplified scene icons 221 in the playback order display region 230 by a method according to the input operation. The control unit 11 displays the simplified scene icons 221 registered in the playback order display region 230 as scene icons 160.

The control unit 11 includes a first scene registration method, a second scene registration method and a third scene registration method, as methods for registering the simplified scene icons 221 in the playback order display region 230. The first to third scene registration methods are substantially identical in content with the first to third scene registration methods of the scene preparation mode.

The content of the detailed scene display mode will be described with reference to FIG. 9. When the playback order editing screen 200 illustrated in FIG. 9 is displayed on the display 81, the control unit 11 performs a process relating to the editing of a scene playback order in the following manner. Upon detecting an input operation for the detailed scene icon 222, the control unit 11 registers the detailed scene icons 222 in the playback order display region 230 by a method according to the input operation. The control unit 11 displays the detailed scene icons 222 registered in the playback order display region 230 as scene icons 160.

The control unit 11 includes a first scene registration method, a second scene registration method and a third scene registration method, as methods for registering the detailed scene icons 222 in the playback order display region 230. The first to third scene registration methods are substantially identical in content with the first to third scene registration methods of the scene preparation mode.

Figure 10A:
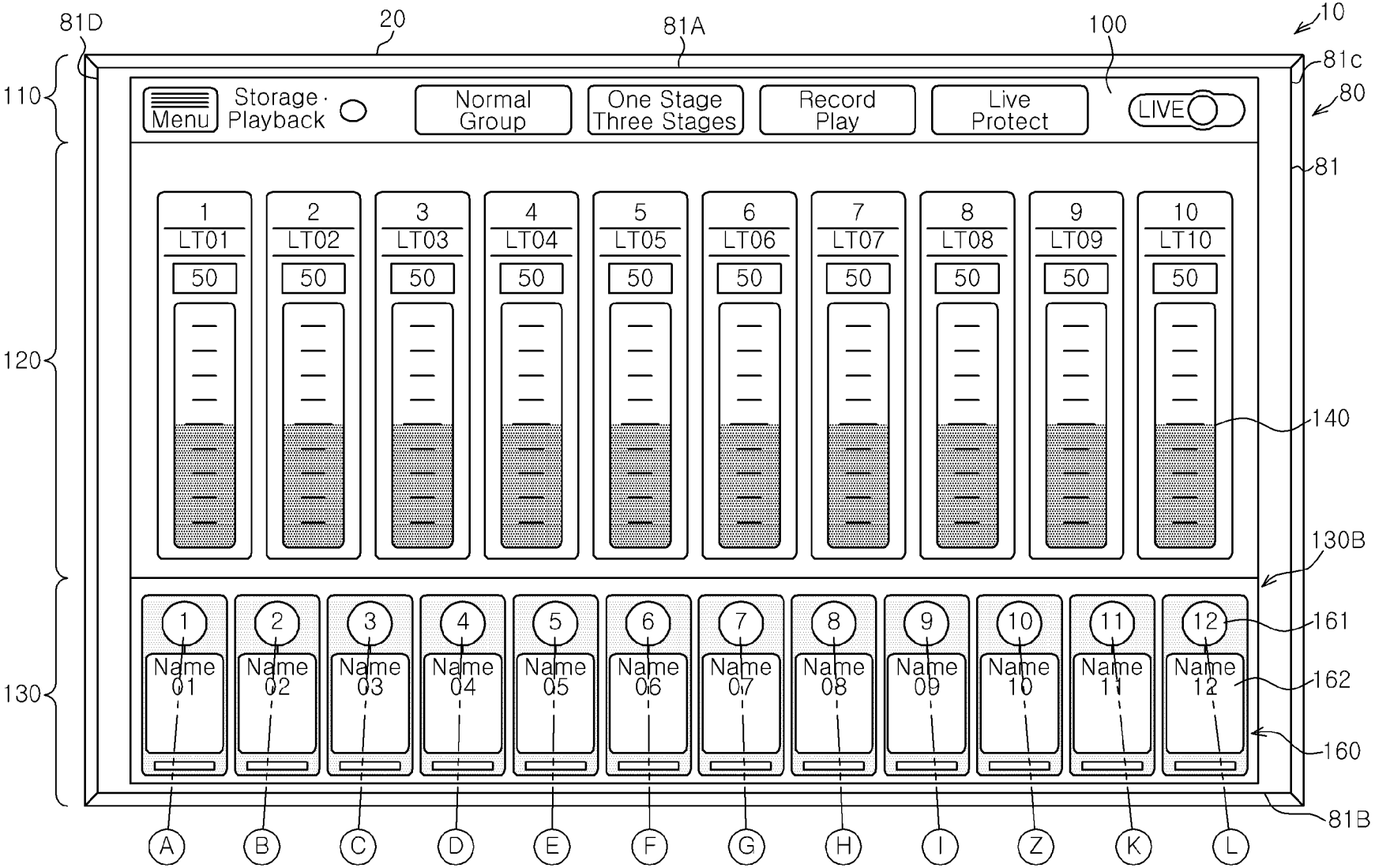
FIGS. 10A and 10B are a front view partially showing the dimming console according to the embodiment.
Figure 10B:
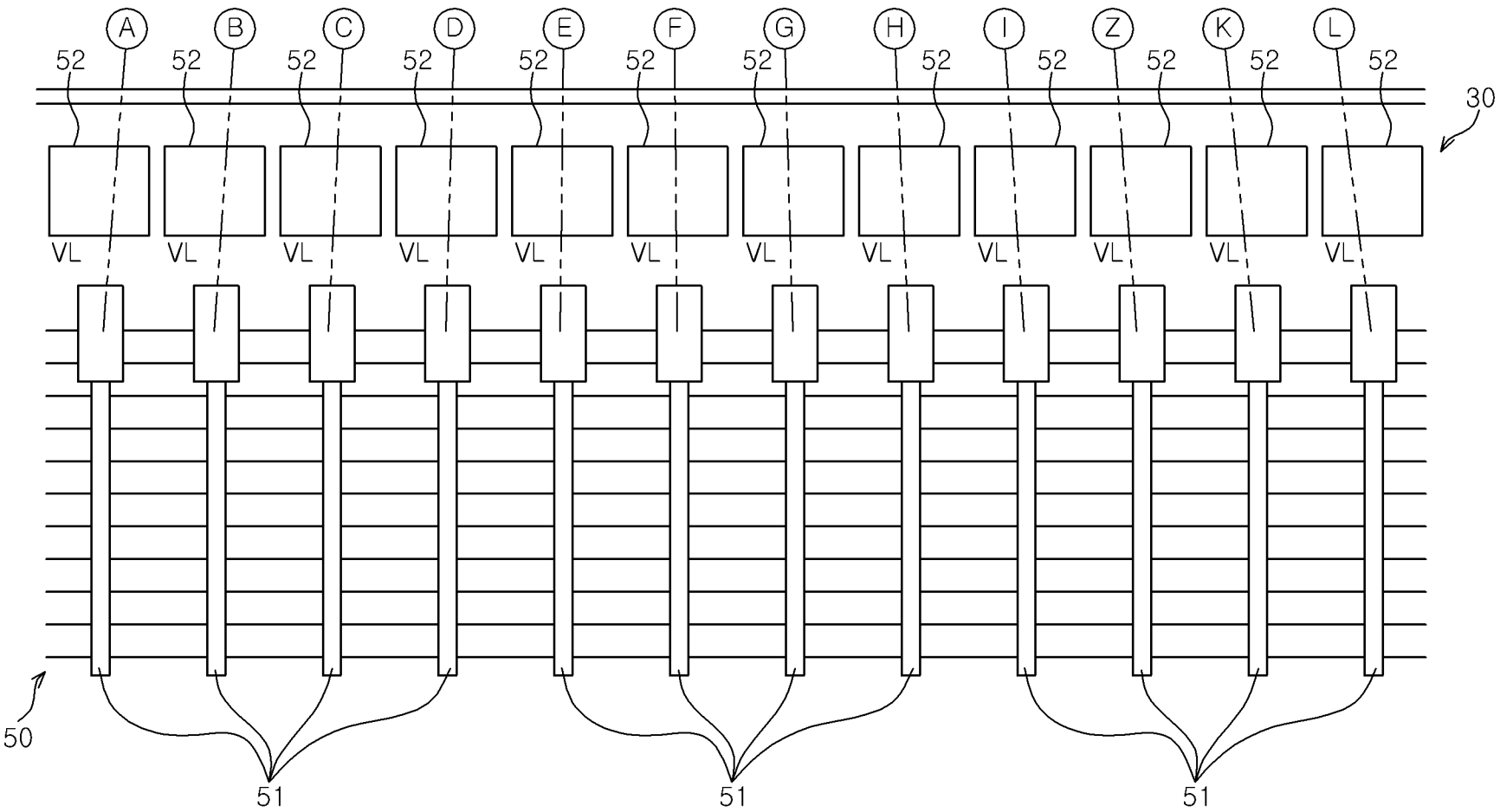

The positional relationship between the display 81 and the fader panel unit 30 in the dimming console 10 will be described with reference to FIGS. 10A and 10B. FIGS. 10A and 10B show the display 81 of the dimming console 10 and a part of the fader panel unit 30.

The fader panel unit 30 is formed at such a position as to adjoin the lower side 81B of the display 81. The respective physical controller parts 50 are formed at such a position as to face the lower side 81B of the display 81 in the height direction of the dimming console 10.

The dimming console 10 defines the lower side 81B of the display 81 adjoining the physical controller parts 50 as an adjoining side. The dimming console 10 defines the virtual line segment, which interconnects a reference portion of the physical fader 51 and a reference portion of the scene icon 160 in the set of the physical controller part 50 and the scene icon 160 corresponding to each other, as a virtual reference line VL. The dimming console 10 defines the positional relationship between the physical controller part 50 and the scene icon 160, in which the virtual reference line VL passes through the adjoining side in the set of the physical controller part 50 and the scene icon 160, as a reference positional relationship.

The dimming console 10 has the respective physical faders 51 disposed at the positions where the reference positional relationship is established with respect to all the sets of the physical controller parts 50 and the scene icons 160. The dimming console 10 illustrated in FIGS. 10A and 10B defines the central portion of a knob of the physical fader 51 as the reference portion of the physical fader 51 and defines the central portion of the scene number display part 161 as the reference portion of the scene icon 160. However, these reference portions are nothing more than one example. The portions differing from those illustrated above may be set as the reference portions of the physical fader 51 and the scene icon 160.

The dimming console 10 provides the following effects.

(1) The dimming console 10 includes the control unit 11, the physical faders 51 and the display 81. The control unit 11 has a function of displaying the scene storage region 130 on the display 81. The scene storage region 130 displays the playback order information relating to a scene playback order. With this configuration, an operator can prepare a scene while visually recognizing the scene playback order. Thus, the dimming console 10 contributes to the efficient preparation of a scene.

(2) The control unit 11 has a function of displaying the scene preparation region 120 on the display 81 and a function of displaying the scene preparation information relating to the preparation of a scene in the scene preparation region 120. With this configuration, an operator can visually recognize the scene preparation information and the playback order information from the display 81. Therefore, as compared with a configuration in which the scene preparation information is not displayed on the display 81, it is possible to reduce the operator's motions required in recognizing different kinds of information. As a result, the dimming console 10 further contributes to the efficient preparation of a scene.

(3) When the scene preparation region 120 is displayed, the control unit 11 displays the scene storage region 130. With this configuration, an operator can visually recognize the information relating to a scene under preparation and the playback order information on a prepared scene at the same time. Therefore, as compared with a configuration in which the scene preparation region 120 and the scene storage region 130 are not displayed on one screen, it is possible to reduce the operator's motions required in recognizing different kinds of information. As a result, the dimming console 10 further contributes to the efficient preparation of a scene.

(4) The control unit 11 displays a plurality of scene icons 160 in the scene storage region 130. Each of the scene icons 160 includes information on one scene. With this configuration, the scene information is converted to an icon on a scene-by-scene basis. This enables an operator to easily perform an operation of moving the scene information on a scene-by-scene basis on the display 81. As a result, the dimming console 10 further contributes to the efficient preparation of a scene.

(5) The control unit 11 displays the scene playback order information by arranging a plurality of scene icons 160 pursuant to a playback order in the scene storage region 130. With this configuration, the scene icons 160 and the playback order information are displayed together. Therefore, as compared with a configuration in which different kinds of information are independently displayed, it is possible to reduce the operator's motions required in visually recognizing the different kinds of information. As a result, the dimming console 10 further contributes to the efficient preparation of a scene.

(6) The control unit 11 displays a plurality of scene icons 160 along a line in the width direction of the display 81. With this configuration, as compared with a configuration in which a plurality of scene icons 160 is arranged in a plurality of rows in the scene storage region 130, an operator can visually recognize the playback order of the scene icons 160 with ease. As a result, the dimming console 10 further contributes to the efficient preparation of a scene.

(7) The control unit 11 displays the scene number display part 161 that indicates the playback order of a plurality of scene icons 160. With this configuration, an operator can visually recognize the scene playback order from at least one of the arrangement order of the scene icons 160 and the scene number display part 161. As a result, the dimming console 10 further contributes to the efficient preparation of a scene.

(8) The control unit 11 displays the scene name display part 162 for identifying the content of a plurality of scene icons 160. With this configuration, an operator can visually recognize the difference in the content of the scene icons 160 without having to perform a motion for displaying the details of the scene information included in the scene icons 160. As a result, the dimming console 10 further contributes to the efficient preparation of a scene.

(9) The control unit 11 displays the scene storage region 130 at the lower side of the scene preparation region 120 in the height direction of the display 81. With this configuration, an operator can register the scene icon 160 in the scene storage region 130 by moving the scene icon 160 downward. Therefore, as compared with a configuration in which the scene storage region 130 is displayed above the scene preparation region 120, an operator can easily perform the registration work of the scene icon 160. Moreover, as compared with the aforementioned configuration, the distance between the registered scene icon 160 and the physical controller part 50 becomes shorter. This enables an operator to visually recognize the correspondence relationship between the scene icon 160 and the physical controller part 50 with ease. As a result, the dimming console 10 further contributes to the efficient preparation of a scene.

(10) Upon detecting an input operation for the storage of a scene, the control unit 11 displays the scene icon 160 which can be moved from the scene preparation region 120 to the scene storage region 130. With this configuration, an operator can select the registration position of the scene icon 160 in the scene storage region 130 by dragging the scene icon 160. This enables an operator to intuitively edit the scene playback order in the scene rank 130B. As a result, the dimming console 10 further contributes to the efficient preparation of a scene.

(11) In response to the operator's input operation for the scene storage region 130 of the scene preparation screen 100, the control unit 11 changes the arrangement order of the scene icons 160 in the scene storage region 130. With this configuration, an operator can edit the scene playback order on both the scene preparation screen 100 and the playback order editing screen 200. As a result, the dimming console 10 further contributes to the efficient preparation of a scene.

(12) The control unit 11 includes the executors 150. With this configuration, it is possible to set various kinds of functions with respect to the physical faders 51. This makes it possible to reduce the number of the physical faders 51 mounted to the dimming console 10.

(13) The dimming console 10 provides the following advantageous effects over a dimming console having a hypothetical configuration (hereinafter referred to as a "hypothetical dimming console"). The hypothetical dimming console differs from the dimming console 10 in terms of the method of displaying a scene storage region on a scene preparation screen. The hypothetical dimming console displays a plurality of scene icon in the scene storage region. The hypothetical dimming console does not display playback order information in the scene storage region. That is to say, the scene storage region of the hypothetical dimming console displays a plurality of scene icons regardless of the scene playback order. For that reason, if an operator of the hypothetical dimming console wishes to know the playback order of a prepared scene during the preparation of a scene, there is a need for the operator to stop the preparation of a scene and to perform a work for checking the playback order. For that reason, there is a fear that the scene preparation efficiency is reduced.

On the other hand, according to the dimming console 10, as mentioned in item (1), an operator can visually recognize the scene playback order while preparing a scene. This helps reduce the frequency at which an operator stops the scene preparation work in order to check the scene playback order. Therefore, as compared with a case where the hypothetical dimming console is used, it is possible to increase the scene preparation efficiency.

(14) The dimming console 10 includes the physical faders 51, the display 81 and the control unit 11. The control unit 11 has a function of displaying the scene master faders as virtual faders and the scene icons 160 on the display 81. The physical faders 51 have a function of playing back the scenes associated with the scene icons 160. With this configuration, the scenes can be played back by the virtual faders and the physical faders 51. For that reason, an operator can obtain an operation feeling available in an ordinary dimming console by playing back the scenes through the use of the physical faders 51.

(15) The physical faders 51 are arranged side by side along a line in the width direction of the dimming console 10. The control unit 11 displays a plurality of scene icons 160 by arranging the scene icons 160 side by side in the same direction as the direction of the row of the physical faders 51. With this configuration, the physical faders 51 and the scene icons 160 are arranged in the same direction. For that reason, it becomes easy for an operator to intuitively recognize the correspondence relationship between the physical faders 51 and the scene icons 160.

(16) The control unit 11 has a function of displaying the same number of the scene icons 160 as the number of the physical faders 51. With this configuration, when the same number of the scene icons 160 as the number of the physical faders 51 are is displayed, it becomes easy for an operator to intuitively recognize the correspondence relationship between the physical faders 51 and the scene icons 160.

(17) The dimming console 10 includes a plurality of physical faders 51 at the lower side of the display 81. The control unit 11 displays the scene icons 160 at the lower side of the instrument faders 140. With this configuration, the instrument faders 140, the scene icons 160 and the physical faders 51 are arranged side by side along the fader operation direction. Thus, the operator's operation feeling for the faders is improved. As compared with a configuration in which the scene icons 160 are disposed above the instrument faders 140, the distance between the scene icons 160 and the physical fader 51 becomes shorter. For that reason, it becomes easy for an operator to intuitively recognize the correspondence relationship between the physical faders 51 and the scene icons 160.

(18) The control unit 11 defines the lower side 81B of the display 81 adjoining the physical controller parts 50 as an adjoining side. The control unit 11 defines the positional relationship between the physical faders 51 and the scene icons 160, in which the virtual reference line VL interconnecting the reference portion of each of the physical faders 51 and the reference portion of each of the scene icons 160 passes through the adjoining side, as a reference positional relationship. The control unit 11 displays the scene icons 160 at the positions where the reference positional relationship is established. With this configuration, one physical fader 51 and one scene icon 160 have a linear positional relationship or a positional relationship similar to the linear positional relationship. For that reason, it becomes easy for an operator to intuitively recognize the correspondence relationship between the physical faders 51 and the scene icons 160.

(Second Embodiment)

Figure 11:
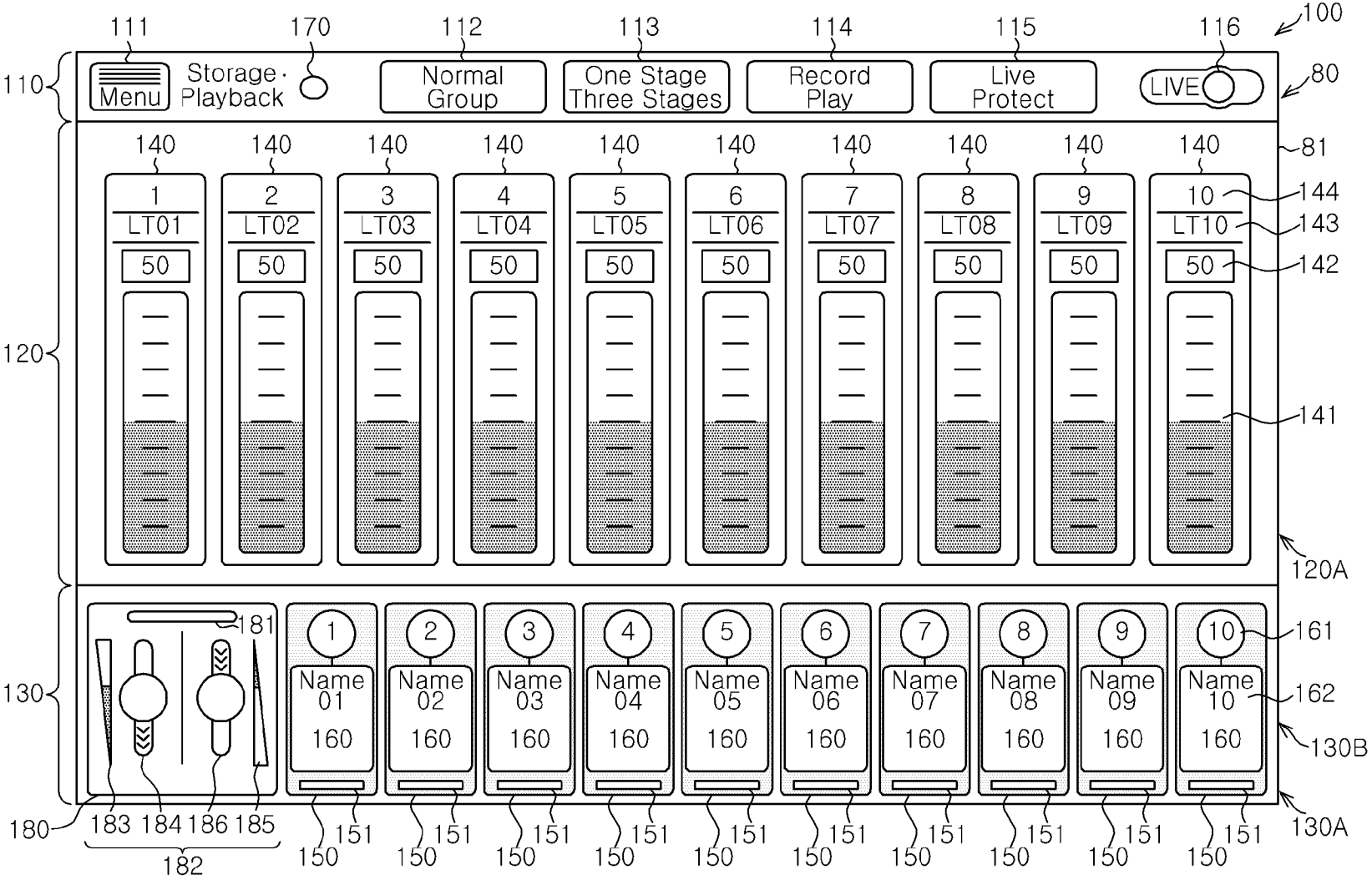
FIG. 11 is a front view illustrating one example of a scene preparation screen according to another embodiment.

The configuration of a dimming console 10 according to a second embodiment will be described with reference to FIG. 11. The dimming console 10 of the second embodiment differs in configuration from the dimming console 10 of the first embodiment in terms of the following points. The dimming console 10 of the second embodiment and the dimming console 10 of the first embodiment have substantially the same configurations in the other points. The configurations of the dimming console 10 of the second embodiment identical with those of the dimming console 10 of the first embodiment will be designated by like reference symbols with the description thereon partially or wholly omitted.

The control unit 11 of the first embodiment displays a plurality of executors 150, in which the scene icons 160 can be registered, in the scene storage region 130. On the other hand, the control unit 11 of the second embodiment displays an executor 180 in the scene storage region 130, instead of the executors 150 arranged at the left end and the next position in the executor rank 130A of the first embodiment. The difference between the dimming console 10 of the second embodiment and the dimming console 10 of the first embodiment will now be described in detail.

The executor 180 has a function of registering virtual faders. The executor 180 includes, as one example of registrable virtual faders, a cross fader, a move fader, a scene fader, a scene master fader, a group master fader and a free fader.

The executor 180 includes a cross fader as one example of a default value of the registrable virtual faders. The executor 180 has a function of controlling the physical faders 51 as programmable faders. The executor 180 allots the function identical with the function of a registered virtual fader as a soft fader function of the physical faders 51.

The executor 180 includes a state display part 181 and across fader 182 as a virtual fader. When the virtual fader is registered, the executor 180 displays the state display part 181. When the virtual fader is not registered, the executor 180 does not display the state display part 181.

The state display part 181 displays the operation state of the corresponding virtual fader and the state of the scene played back by the corresponding virtual fader. The display content of the state display part 181 is set depending on the virtual fader registered in the executor 180.

The cross fader 182 includes an A fader 183, an A level display part 184, a B fader 185 and a B level display part 186. In response to the input operation for the A fader 183 or the B fader 185, the cross fader 182 changes the output level of the lighting instruments 3. The A level display part 184 displays the magnitude of the output level set by the A fader 183 and the change direction of the output level set by the A fader 183. The B level display part 186 displays the magnitude of the output level set by the B fader 185 and the change direction of the output level set by the B fader 185.

Upon detecting a tap operation for the executor 180, the control unit 11 displays a fader setting menu (not shown). The control unit 11 registers the virtual fader selected from the fader setting menu in the executor 180. When the cross fader 182 is selected from the fader setting menu, the control unit 11 displays the cross fader 182 on the executor 180. The control unit 11 associates the virtual fader (the cross fader 182) selected from the fader setting menu with the lighting instrument 3 selected from the fader setting menu.

The dimming console 10 of the second embodiment provide the same effects as the effects (1) to (18) provided by the dimming console 10 of the first embodiment. That is to say, the dimming console 10 of the second embodiment provides the effect of contributing to the efficient preparation of a scene and many other effects.

[Other Embodiments]

The present dimming console may take many different specific forms differing from the first and second embodiments along as the object of the invention is accomplished. The following modified examples of the first and second embodiments are examples of additional specific forms that can be taken by the present dimming console.

A control unit 11 of a modified example has at least one of scene control and external level input control. The scene control is executed in order to control the light pattern of a lighting production scene. The external level input control is executed in order to control the level of an external level.

A control unit 11 of a modified example has a dynamic editing function. The dynamic editing function refers to a function of suitably editing a series of motions of light that constitute the lighting production scene. The dynamic editing function includes, for example, chase editing, flash (blink) editing, effect editing, and the like. However, the specific functions included in the dynamic editing function are not limited to the functions illustrated herein. The control unit 11 of the modified example includes, as one example of the dynamic editing function, at least one of the chase editing and the effect editing.

A control unit 11 of a modified example displays a plurality of color setting icons in the scene preparation region 120 in the scene preparation mode (modified example A). The control unit 11 sets a color identical with the color information of each of the color setting icons as a display color of each of the color setting icons. The control unit 11 detects a color selected by an operator, based on the input operation for the color setting icons, and sets the detected color as a color of the instrument faders 140.

The control unit 11 of the modified example A may take the following control form. When the color setting icons are selected, the control unit 11 displays a color controller in the scene preparation region 120. The color controller is a phase displayed over the instrument fader 140 which is already displayed.

The control unit 11 registers the color setting icons selected by an operator in the color controller. The control unit 11 collectively controls the color levels of the color setting icons registered in the color controller. As one example of this control, the control unit 11 sets the ratio of the color levels of the color setting icons and changes the color levels of the color setting icons in conjunction with one another based on the ratio thus set. The ratio of the color level may be changed by an operator.

For example, if an operator performs an input operation of adjusting the color level of one color setting icon, the control unit 11 changes the color levels of the color setting icons registered in the color controller, including this color setting icon, based on the ratio set as above. The changes in the color levels of the respective color setting icons are reflected in the corresponding instrument faders 140. Thus, the color levels of the instrument faders 140 are collectively changed.

The control unit 11 of the modified example A may take the following control form. In the scene preparation mode, the control unit 11 displays a color phase display icon in the scene preparation region 120. In response to an input operation for the color phase display icon, the control unit 11 displays a color setting phase in the scene preparation region 120. For example, upon detecting the color phase display icon being pressed long, the control unit 11 displays the color setting phase. The color setting phase is displayed over the instrument fader 140 which is already displayed.

The control unit 11 displays a plurality of color setting icons in the color setting phase. In response to an input operation for the color setting phase, the control unit 11 detects the color selected by an operator and sets the detected color as a color of the instrument fader 140. After setting the color of the instrument fader 140, the control unit 11 close the color setting phase and displays the set color in the scene preparation region 120 in a corresponding relationship with the instrument fader 140.

In the scene preparation mode, a control unit 11 of a modified example displays a function setting icon in the scene preparation region 120. The control unit 11 sets an irradiation function of the instrument fader 140 based on the input operation for the function setting icon. Examples of the irradiation function include blinking, zoom and strobe.

For example, if the blinking is selected by the input operation for the function setting icon, the control unit 11 sets the irradiation function of the corresponding instrument fader 140 as the blinking. If the lighting instruments 3 have a data sheet, the control unit 11 can set the level of the irradiation function with reference to the data sheet.

A control unit 11 of a modified example has a scene preview function. The scene preview function refers to a function of playing back the scene information included in the scene icon 160 for a prescribed time. For example, the control unit 11 sets a relatively short period of time suitable for the preview of a scene as the prescribed time. The prescribed time may be set by an operator.

For example, upon detecting a tap operation for the scene icon 160, the control unit 11 plays back the scene corresponding to the scene icon 160 on the scene icon 160 until the prescribed time is elapsed. With this configuration, an operator can prepare a scene while checking the specific content of the scene information included in the scene icon 160. This makes it possible to efficiently prepare a scene.

The control unit 11 of the first and second embodiment displays the first instrument display mode switching part 112, the second instrument display mode switching part 113, the first operation function switching part 114, the second operation function switching part 115 and the in-playback editing button 116 in the function display region 110. However, the content of the function parts displayed in the function display region 110 is not limited to the content illustrated in the embodiments. For example, at least one of the first instrument display mode switching part 112, the second instrument display mode switching part 113, the first operation function switching part 114, the second operation function switching part 115 and the in-playback editing button 116 may be omitted from the function display region 110.

The control unit 11 of the first and second embodiment has the one-stage display mode and the three-stage display mode in the second instrument display mode switching part 113. However, the content of the second instrument display mode switching part 113 is not limited to the content illustrated in the embodiments. For example, a control unit 11 of a modified example may have a two-stage display mode and a display mode of four or more stages.

The control unit 11 of the first and second embodiment displays the scene storing button 170 in the function display region 110. However, the display position of the scene storing button 170 is not limited to the position illustrated in the embodiments. For example, a control unit 11 of a modified example may display the scene storing button 170 in the scene preparation region 120 or the scene storage region 130.

The control unit 11 of the first and second embodiment starts to store a scene in response to the input operation for the scene storing button 170. However, the method for storing a scene is not limited to the method illustrated in the embodiments. For example, a control unit 11 of a modified example may display a menu including an item for the storage of a scene in response to the input operation for the menu button 111. Upon detecting an input operation of selecting the item, the control unit 11 displays the scene icon 160 in the scene preparation region 120. According to one example of this configuration, the scene storing button 170 is omitted.

The control unit 11 of the first and second embodiment displays the respective executors 150 by arranging the executors 150 side by side in the width direction of the display 81. However, the display method of the respective executors 150 is not limited to the method illustrated in the embodiments. For example, a control unit 11 of a modified example may display the respective executors 150 by arranging the executor 150 side by side in the height direction of the display 81.

The control unit 11 of the first embodiment includes the same number of the executors 150 as the number of the physical faders 51. However, the setting number of the executors 150 is not limited to the number illustrated in the first embodiment. For example, a control unit 11 of a modified example may form the executor rank 130A using the executors 150 larger in number than the physical faders 51. In response to a flick operation for the executor rank 130A, the control unit 11 scrolls the executor rank 130A, thereby changing the executors 150 displayed in the scene storage region 130.

The control unit 11 of the first and second embodiment displays the playback order information in the scene storage region 130 by arranging the scene icons 160 in the scene rank 130B pursuant to the playback order. However, the display method of the playback order information is not limited to the method illustrated in the embodiments. For example, a control unit 11 of a modified example may display scene playback order information in the scene storage region 130 independently of the scene rank 130B. The control unit 11 of this modified example displays the scene playback order information in the scene storage region 130 by displaying a playback number image indicative of the playback order of individual scenes based on different kinds of scene information stored. According to one example of this configuration, the scene rank 130B is omitted.

The control unit 11 of the first and second embodiment registers the scene icon 160 in the scene storage region 130 in response to a drag-and-drop operation of the scene icon 160. However, the method for registering the scene icon 160 in the scene storage region 130 is not limited to the method illustrated in the embodiments. For example, a control unit 11 of a modified example may have at least one of the following registration methods (a) to (c).

(a) Upon detecting a pressing operation of the scene storing button 170, a control unit 11 of a modified example registers a new scene icon 160 at a predetermined storage position of the scene rank 130B. For example, the end of the scene rank 130B may be set as the predetermined storage position.

(b) Upon detecting a pressing operation of the scene storing button 170, a control unit 11 of a modified example displays a registration-purpose menu for setting a registration position of the scene icon 160 in the scene rank 130B. The control unit 11 displays an insertion position of the scene icon 160 and an overwrite position of the scene icon 160 in the registration-purpose menu. Upon detecting an input operation of designating the insertion position, the control unit 11 registers a new scene icon 160 in the insertion position of the scene rank 130B. Upon detecting an input operation of designating the overwrite position, the control unit 11 registers a new scene icon 160 instead of the scene icon 160 arranged at the overwrite position of the scene rank 130B.

(c) Upon detecting a pressing operation of the scene storing button as a physical button, a control unit 11 of the modified example registers a new scene icon 160 at a predetermined storage position of the scene rank 130B. For example, the end of the scene rank 130B may be set as the predetermined storage position.

The control unit 11 of the first and second embodiment displays the function display region 110, the scene preparation region 120 and the scene storage region 130 in one scene preparation screen 100. However, the display method of the respective region in the scene preparation screen 100 is not limited to the method illustrated in the embodiments. For example, a control unit 11 of a modified example may have one of the following display methods (a) to (c) instead of the display method of the embodiments.

(a) A control unit 11 of a modified example displays the scene preparation region 120 and the scene storage region 130 on one scene preparation screen 100 and does not display the function display region 110. Upon detecting an input operation for calling out the function display region 110, the control unit 11 displays the function display region 110 instead of the scene preparation region 120 and the scene storage region 130. Alternatively, the control unit 11 may display the function display region 110 in the scene preparation region 120 and the scene storage region 130.

(b) A control unit 11 of modified example displays the function display region 110 and the scene preparation region 120 on one scene preparation screen 100 and does not display the scene storage region 130. Upon detecting an input operation for storing a scene, the control unit 11 displays the scene storage region 130 instead of the function display region 110 and the scene preparation region 120. Alternatively, the control unit 11 may display the scene storage region 130 in the function display region 110 and the scene preparation region 120.

(c) A control unit 11 of a modified example displays the scene preparation region 120 on the scene preparation screen 100 and does not display the function display region 110 and the scene storage region 130. Upon detecting an input operation for calling out the function display region 110, the control unit 11 displays the function display region 110 instead of the scene preparation region 120, or displays the function display region 110 on the scene preparation region 120. Upon detecting an input operation for storing a scene, the control unit 11 displays the scene storage region 130 instead of the scene preparation region 120, or displays the scene storage region 130 on the scene preparation region 120.

The control unit 11 of the first and second embodiment displays the function display region 110, the scene preparation region 120 and the scene storage region 130 on the scene preparation screen 100 in that order from the upper side toward the lower side. However, the display method of the respective regions on the scene preparation screen 100 is not limited to the method illustrated in the embodiments. For example, a control unit 11 of a modified example may display the respective regions by one of the following display methods (a) to (d) instead of the display method of the embodiments.

(a) A control unit 11 of a modified example displays the function display region 110, the scene storage region 130 and the scene preparation region 120 on the scene preparation screen 100 in that order from the upper side toward the lower side.

(b) A control unit 11 of a modified example displays the scene storage region 130, the function display region 110 and the scene preparation region 120 on the scene preparation screen 100 in that order from the upper side toward the lower side.

(c) A control unit 11 of a modified example displays the scene preparation region 120, the function display region 110 and the scene storage region 130 on the scene preparation screen 100 in that order from the upper side toward the lower side.

(d) A control unit 11 of a modified example displays the scene preparation region 120, the scene storage region 130 and the function display region 110 on the scene preparation screen 100 in that order from the upper side toward the lower side.

The dimming console 10 of the first and the second embodiments includes the physical controller part 50 arranged at the lower side of the display 81. However, the arrangement position of the physical controller part 50 is not limited to the position illustrated in the embodiments. For example, the dimming console 10 may include the physical controller part 50 arranged at the upper side of the display 81.

The dimming console 10 of the first and the second embodiments includes the physical controller part 50 arranged at the lower side of the display 81. The physical faders 51 have the same operation direction as the height direction of the dimming console 10. However, the configuration of the physical controller part 50 is not limited to the configuration illustrated in the embodiments. For example, a dimming console 10 of a modified example may include a physical controller part arranged at the right side or the left side of the display 81. The physical faders of this modified example have the same operation direction as the width direction of the dimming console 10.

In the dimming console 10 of the first and the second embodiments, the physical faders 51 are arranged side by side along a line in the width direction of the dimming console 10. However, the arrangement pattern of the physical faders 51 is not limited to the arrangement pattern illustrated in the embodiments. For example, in a dimming console 10 of a modified example, the physical faders 51 may be arranged at the positions adjoining at least two of the upper side 81A, the lower side 81B, the right side 81C and the left side 81D of the display 81.

The dimming console 10 of the first and the second embodiments includes the fader panel unit 30, one of the function parts, arranged at the position adjoining the display 81. However, the arrangement pattern of the function parts around the display 81 is not limited to the arrangement pattern illustrated in the embodiments. For example, a dimming console 10 of a modified example may have another function part arranged between the display 81 and the fader panel unit 30.

The dimming console 10 of the first and the second embodiments displays the function display region 110, the scene preparation region 120 and the scene storage region 130 on one display 81. However, the display method of the respective regions on the display 81 is not limited to the method illustrated in the embodiments. For example, a dimming console 10 of a modified example may have one of the following display methods (a) to (c) instead of the display method of the embodiments.

(a) A dimming console 10 of a modified example includes a first display and a second display instead of the display 81. The control unit 11 displays one or two of the function display region 110, the scene preparation region 120 and the scene storage region 130 on the first display. The control unit 11 displays the remaining one or two of the function display region 110, the scene preparation region 120 and the scene storage region 130 on the second display.

(b) A dimming console 10 of a modified example includes a first display, a second display and a third display instead of the display 81. The control unit 11 displays the function display region 110 on the first display. The control unit 11 displays the scene preparation region 120 on the second display. The control unit 11 displays the scene storage region 130 on the third display.

(c) A dimming console 10 of a modified example includes four or more displays instead of the display 81. The control unit 11 displays the function display region 110, the scene preparation region 120 and the scene storage region 130 on the mutually different displays. Alternatively, the control unit 11 may display the respective regions by a method similar to the display method (a) or (b) mentioned above.

The dimming console 10 of the first and the second embodiments includes the display 81 having a rectangular shape. However, the shape of the display 81 is not limited to the shape illustrated in the embodiments. For example, a dimming console 10 of a modified example may include a display 81 having a triangular shape or a polygonal shape with five or more sides.

The dimming console 10 of the first and the second embodiments includes the touch panel 80 as a user interface for the preparation of a scene. However, the configuration of the user interface for the preparation of a scene is not limited to the configuration illustrated in the embodiments. For example, a dimming console 10 of a modified example may include at least one of a mouse and a keyboard in addition to or in place of the touch panel 80.

The dimming console 10 of the first and the second embodiments has a configuration in which the fader panel unit 30 and the display 81 are formed in one console housing 20. However, the configuration of the dimming console 10 is not limited to the configuration illustrated in the embodiments. For example, a dimming console 10 of a modified example may have a configuration in which the display 81 is omitted. The dimming system 1 may have a display installed independently of the dimming console 10.

The dimming system 1 of the first and second embodiments uses DMX512 as a communication protocol of the dimming console 10 with the dimming devices 2 and the lighting instruments 3. However, the communication protocol used in the dimming system 1 is not limited to the communication protocol illustrated in the embodiments.

In the dimming system 1 of the first and second embodiments, the communication between the dimming console 10 and the dimming devices 2 is performed through a wire. On the other hand, in a dimming system 1 of a modified example, the communication between the dimming console 10 and the dimming devices 2 is performed in a wireless manner.

In the dimming system 1 of the first and second embodiments, the communication between the dimming devices 2 and the lighting instruments 3 is performed through a wire. On the other hand, in a dimming system 1 of a modified example, the communication between the dimming devices 2 and the lighting instruments 3 is performed in a wireless manner.

(Supplementary Notes on Problem Solving Means)

The problem solving means include the following supplementary notes.

[Supplementary Note 1] The dimming console of claim 4 or 5 includes the following matters. The control unit displays the scene icons along a line in the width direction of the display.

[Supplementary Note 2] The dimming console of claim 4 or 5 or supplementary note 1 includes the following matters. The control unit displays number information indicative of a playback order of the scene icons.

[Supplementary Note 3] The dimming console of claim 4 or 5 or supplementary note 1 or 2 includes the following matters. The control unit displays identification information for identifying the content of the scene icons.

[Supplementary Note 4] The dimming console of claim 2, the dimming console of any one of claims 3 to 5 referring back to claim 2, or the dimming console of any one of supplementary notes 1 to 3 referring back to claim 2 includes the following matters. The control unit displays the scene storage region at the lower side of the scene preparation region.

[Supplementary Note 5] The dimming console of any one of claims 1 to 5 or the dimming console of any one of supplementary notes 1 to 4 includes the following matters. The dimming console includes an input detection unit. The input detection unit detects an operator's input operation. The control unit changes the information displayed on the display, in response to the input operation detected by the input detection unit.

[Supplementary Note 6] The dimming console of supplementary note 5 directly or indirectly referring back to claim 2 includes the following matters. When an input operation for storing a scene is detected by the input detection unit, the control unit displays a scene icon movable across the scene preparation region and the scene storage region on the display.

[Supplementary Note 7] The dimming console of supplementary note 6 includes the following matters. When an input operation of moving the scene icon from the scene preparation region to the scene storage region is detected by the input detection unit, the control unit registers the scene icon in the scene storage region.

[Supplementary Note 8] The dimming console of any one of supplementary notes 4 to 7 includes the following matters. In response to an input operation for the scene icon registered in the scene storage region, the control unit changes the arrangement order of the scene icons in the scene storage region.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teaching.

What is claimed is:

1. A dimming console which is to be connected to a plurality of lighting instruments, the dimming console serving to store output levels of the plurality of lighting instruments and control the plurality of lighting instruments, the dimming console comprising:

an output unit configured to output, to a display, a scene preparation region that displays scenes indicating at least states of the output levels of the plurality of lighting instruments and a scene storage region indicating playback order information regarding a scene playback order;

an input unit configured to receive an operation for the scene preparation region and an operation for the scene storage region; and a control unit configured to edit the scenes or the play back order information pursuant to the operations of the input unit and to control the output unit to output the edited scenes or the edited playback order information.

2. The dimming console of claim 1, wherein in the scene storage region, a plurality of scene icons, which indicates the scenes, are arranged based on the scene playback order.

3. The console of claim 1, wherein, the input unit includes a touch panel.

4. A method for operating a plurality of lighting instruments by using a dimming console which is connected to the plurality of lighting instruments, and serves to store output levels of the plurality of lighting instruments and control the plurality of lighting instruments, the method comprising:

instructing an output unit of the dimming console to output, to a display, a scene preparation region that displays scenes indicating at least states of the output levels of the plurality of lighting instruments and a scene storage region indicating playback order information regarding a scene playback order;

receiving an operation for the scene preparation region and an operation for the scene storage region through an input unit of the dimming console;

editing the scenes or the playback order information pursuant to instruction received through the input unit and controlling the output unit to output the edited scenes or the edited playback order information to the display; and instructing the plurality of lighting instruments to play back the scenes sequentially pursuant to the instruction received through the input unit.

* * * * *